US007013654B2

(12) United States Patent
Tremblay et al.

(10) Patent No.: US 7,013,654 B2
(45) Date of Patent: Mar. 21, 2006

(54) METHOD AND DEVICE FOR ELIMINATING CONNECTING WEBS BETWEEN ICE CUBES

(75) Inventors: Dennis D. Tremblay, Geneva, IL (US); Laurence S. Slocum, Mooresville, IN (US); Ronald E. Cole, Greenwood, IN (US)

(73) Assignee: Emerson Electric Company, St. Louis, MO (US)

( * ) Notice: Subject to any disclaimer, the term of this patent is extended or adjusted under 35 U.S.C. 154(b) by 0 days.

(21) Appl. No.: 10/895,792

(22) Filed: Jul. 21, 2004

(65) Prior Publication Data

US 2006/0016205 A1 Jan. 26, 2006

(51) Int. Cl.
*F25C 5/02* (2006.01)

(52) U.S. Cl. ..... 62/73; 62/353

(58) Field of Classification Search ..... 62/68, 62/71, 73, 347, 351, 353
See application file for complete search history.

(56) References Cited

U.S. PATENT DOCUMENTS

| | | | | |
|---|---|---|---|---|
| 2,109,822 | A | | 3/1938 | Eddy |
| 2,514,942 | A | | 7/1950 | Eaton |
| 2,756,567 | A | | 7/1956 | Martin |
| 3,027,731 | A | | 4/1962 | Lindenberg et al. |
| 3,029,609 | A | | 4/1962 | Zearfoss, Jr. |
| 3,299,656 | A | | 1/1967 | Linstromberg et al. |
| 3,396,552 | A | | 8/1968 | Buchser |
| 3,418,823 | A | | 12/1968 | Vivai |
| 3,433,030 | A | | 3/1969 | Jacobs |
| 3,620,497 | A | | 11/1971 | Schaff |
| 4,045,979 | A | | 9/1977 | Mazzini |
| 4,207,750 | A | | 6/1980 | Simkins |
| 4,429,550 | A | | 2/1984 | Latter |
| 4,487,024 | A | | 12/1984 | Fletcher et al. |
| 4,573,325 | A | | 3/1986 | Chiu et al. |
| 4,649,718 | A | * | 3/1987 | Linstromberg et al. ..... 62/340 |
| 4,685,304 | A | | 8/1987 | Essig |
| 4,727,720 | A | | 3/1988 | Wernicki |
| 4,923,494 | A | | 5/1990 | Karlovits |
| 4,966,004 | A | | 10/1990 | Midlang et al. |
| 5,038,573 | A | | 8/1991 | McAllister |
| 5,129,237 | A | | 7/1992 | Day et al. |

(Continued)

*Primary Examiner*—William E Tapolcai
(74) *Attorney, Agent, or Firm*—Maginot Moore & Beck

(57) ABSTRACT

A method and device for making ice is disclosed. The icemaker assembly comprises an ice tray and an ice ejector. The ice tray has at least (i) a first ice forming compartment defining a first space, and (ii) a second ice forming compartment defining a second space. The ice ejector is positionable at a first position and a second position. The ice ejector has at least (i) a first ejector member, and (ii) a second ejector member. When the ice ejector is positioned at the first position, (i) the first ejector member is positioned in the first space and in contact with a first quantity of water, (ii) the second ejector member is positioned in the second space and in contact with a second quantity of water, and (iii) the first quantity of water is positioned in fluid communication with the second quantity of water. When the ice ejector is positioned at the second position, (i) the first ejector member is spaced apart from both the first space and the first quantity of water, (ii) the second ejector member is spaced apart from both the second space and the second quantity of water, and (iii) the first quantity of water is isolated from fluid communication with the second quantity of water.

33 Claims, 21 Drawing Sheets

U.S. PATENT DOCUMENTS

| | | | |
|---|---|---|---|
| 5,182,916 | A | 2/1993 | Oike et al. |
| 5,619,858 | A | 4/1997 | Gunderson et al. |
| 5,922,030 | A | 7/1999 | Shank et al. |
| 6,067,806 | A | 5/2000 | Park |
| 6,092,374 | A | 7/2000 | Kang et al. |
| 6,357,720 | B1 | 3/2002 | Shapiro et al. |
| 6,401,461 | B1 | 6/2002 | Harrison et al. |
| 6,513,337 | B1 | 2/2003 | Astvatsatrian et al. |
| 2001/0039802 | A1 | 11/2001 | Barrash |
| 2001/0039824 | A1 | 11/2001 | Newman et al. |
| 2003/0010053 | A1 | 1/2003 | Kim et al. |
| 2005/0072166 | A1 * | 4/2005 | Lee et al. ..... 62/135 |

* cited by examiner

METHOD AND DEVICE FOR ELIMINATING CONNECTING WEBS BETWEEN ICE CUBES

CROSS REFERENCE

Cross reference is made to co-pending U.S. patent applications Ser. No. 10/895,665, entitled Method and Device for Stirring Water During Icemaking and Ser. No. 10/895,570, entitled Method and Device for Producing Ice Having a Harvest-facilitating Shape, which are assigned to the same assignee as the present invention, and which are filed concurrently herewith, the disclosure of which are hereby incorporated by reference in their entirety.

BACKGROUND AND SUMMARY

This invention relates to household icemakers and more particularly to icemakers having a tray including multiple compartments filled by introducing water into a single compartment which overflows into adjacent compartments to fill compartments to similar levels.

Refrigerators with icemakers are a popular consumer item, and most side-by-side refrigerator/freezers have icemakers installed as standard items. In a typical refrigerator/freezer with an icemaker, water is introduced into ice forming compartments in an ice tray and allowed to freeze to form ice cubes. Some typical icemakers have six separate compartments while some others have seven. The depth and shape of the compartment may vary between manufacturers, but the ice trays currently utilized by most icemaker manufactures are quite similar. Such ice trays 2020 generally include crescent-shaped compartments 2066 with an opening or weir 2090 between each compartment 2066 to allow the water to flow and fill evenly at the beginning of the ice making process, as shown, for example, in FIG. 23. Most icemaker trays are manufactured in a casting process.

Typically, water is allowed to flow into the ice tray 2020 until each of the compartments 2066 is filled to a desired level. The water is then allowed to stand in the tray 2020 until it freezes. After freezing, an ejector arm rotates so that a separate finger extends into each compartment 2066 to urge the ice formed therein to be ejected. After ejecting the ice, the ejector arm in typical icemakers returns to a position wherein each of the fingers is disposed completely outside of the compartment 2066 during the next filling and freezing cycle.

Traditional ice compartment designs contain a slot or weir 2090 between each compartment to allow the water level to be evenly distributed. This method has been widely used in the process of automatic icemakers in home refrigerator/freezers. The result of this method produces an ice bridge or web between the individual ice cubes. It would be desirable to eliminate this bridge or web between ice cubes to form discrete ice cubes.

Icemakers have a series of compartments in an ice tray that are filled with water. As the water cools, it begins to freeze. The traditional method of evenly filling the water into each compartment of the ice tray 2020 has been to provide a slot 2090 formed in a dividing wall 2080 between compartments 2066 that allows the water to move freely between the compartments 2066. Sufficient water is provided to the tray 2020 to allow the water level in each compartment 2066 to be higher than the bottom of the slot 2090 so that gravity can cause the water to level out. During freezing the water remaining in the slots 2090 after filling the compartments 2066 forms a web or bridge between cubes formed in each compartment 2066. After the cubes are frozen, the ejector arm is rotated so that a finger extends into each compartment 2066 to urge the cube formed therein out of the ice compartment 2066.

Typically, the slot 2090 for water distribution is formed on the ejection side of the compartment 2066 so that the ice bridge need not be broken during ice cube ejection. Nevertheless, the ejector arm often breaks the web or bridge between cubes during the ejection process forming ice chips that can induce the ice cubes to fuse together in the ice bin. Also, remnants of the web or bridge typically remain on the cube forming a less aesthetically pleasing cube.

It would be desirable to eliminate the web or bridge between ice cubes formed in an automatic icemaker. The elimination of the web or bridge would provide more aesthetically pleasing ice cubes. Additionally, the elimination of the web or bridge may reduce the force that the fingers of the ejector arm are subjected to during ejection of the ice cubes as the ejector arm. Elimination of the ice bridge would also reduce the amount of ice chips formed during the ejection process reducing the tendency of the ice cubes to fuse together in the bin.

This disclosure proposes methods for eliminating the bridge between ice cubes and discloses ice trays, ejectors and controllers that cooperate to eliminate an ice bridge or web between cubes formed in the ice tray.

According to one aspect of the disclosure a method of making ice comprises the steps of advancing water into an ice tray of an icemaker assembly and positioning displacement members within a plurality of ice forming compartments of the ice tray, moving the displacement members out of the plurality of ice forming compartments, reducing the temperature of the water within the ice tray and moving the displacement members. The advancing water into an ice tray of an icemaker assembly step and positioning displacement members within a plurality of ice forming compartments of the ice tray step are performed so that for a period of time both the water and the displacement members are simultaneously located within the plurality of ice forming compartments. The moving the displacement members out of the plurality of ice forming compartments step is performed after the period of time. The reducing the temperature of the water within the ice tray step is performed so as to cause the water located within the plurality of ice forming compartments to become a plurality of discrete ice cubes while the displacement members are located out of the plurality of ice forming compartments. The moving the displacement members step moves the displacement members into contact with the plurality of discrete ice cubes so that the plurality of ice cubes are urged out of the plurality of ice forming compartments.

According to another aspect of the disclosure, a method of making ice comprises an advancing step, a positioning step, a moving step, a reducing step and a moving step. The advancing step includes advancing a quantity of water to an ice tray so that the quantity of water is unevenly distributed among a plurality of ice forming compartments of the ice tray. The positioning step includes positioning displacement members within the plurality of ice forming compartments so that a part of the quantity of water is caused to advance from a first number of the plurality of ice forming compartments to a second number of the plurality of ice forming compartments. The moving step includes moving the displacement members out of the plurality of ice forming compartments after the period of time. The reducing step includes reducing the temperature of the water within the ice tray so as to cause the water located within the plurality of ice forming compartments to become a plurality of discrete ice cubes while the displacement members are located out of the plurality of ice forming compartments. The moving step includes moving the displacement members into contact with the plurality of discrete ice cubes so that the plurality of ice cubes are urged out of the plurality of ice forming compartments.

According to still another aspect of the disclosure, a method of filling an ice tray with a quantity of water comprises an advancing step and a positioning step. The advancing step includes advancing the quantity of water to the ice tray so that the quantity of water is unevenly distributed among a plurality of ice forming compartments of the ice tray. The positioning step includes positioning displacement members within the plurality of ice forming compartments so that a part of the quantity of water is caused to advance from a first number of the plurality of ice forming compartments to a second number of the plurality of ice forming compartments.

According still yet another aspect of the disclosure a method of filling an ice tray with a quantity of water, the ice tray having at least (i) a first ice forming compartment defining a first space, (ii) a second ice forming compartment defining a second space, and (iii) a partition member interposed between the first space and the second space is provided. The method comprises a positioning step and an advancing step. The positioning step includes positioning a first displacement member in the first space and a second displacement member in the second space. The advancing step includes advancing the quantity of water within the ice tray. The water level of the quantity of water located within the ice tray is vertically above at least a part of a top edge of the partition when (i) the first displacement member is positioned in the first space, and (ii) the second displacement member is positioned in the second space. The water level of the quantity of water located in said ice tray is vertically below the entire top edge of the partition when (i) the first displacement member is spaced apart from the first space, and (ii) the second displacement member is spaced apart from the second space.

According to another aspect of the disclosure, an icemaker assembly comprises an ice tray and an ice ejector. The ice tray has at least (i) a first ice forming compartment defining a first space, and (ii) a second ice forming compartment defining a second space. The ice ejector is positionable at a first position and a second position. The ice ejector has at least (i) a first ejector member, and (ii) a second ejector member. When the ice ejector is positioned at the first position, (i) the first ejector member is positioned in the first space and in contact with a first quantity of water, (ii) the second ejector member is positioned in the second space and in contact with a second quantity of water, and (iii) the first quantity of water is positioned in fluid communication with the second quantity of water. When the ice ejector is positioned at the second position, (i) the first ejector member is spaced apart from both the first space and the first quantity of water, (ii) the second ejector member is spaced apart from both the second space and the second quantity of water, and (iii) the first quantity of water is isolated from fluid communication with the second quantity of water.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The illustrative devices will be described hereinafter with reference to the attached drawings which are given as non-limiting examples only, in which.

DETAILED DESCRIPTION

Figure 1:
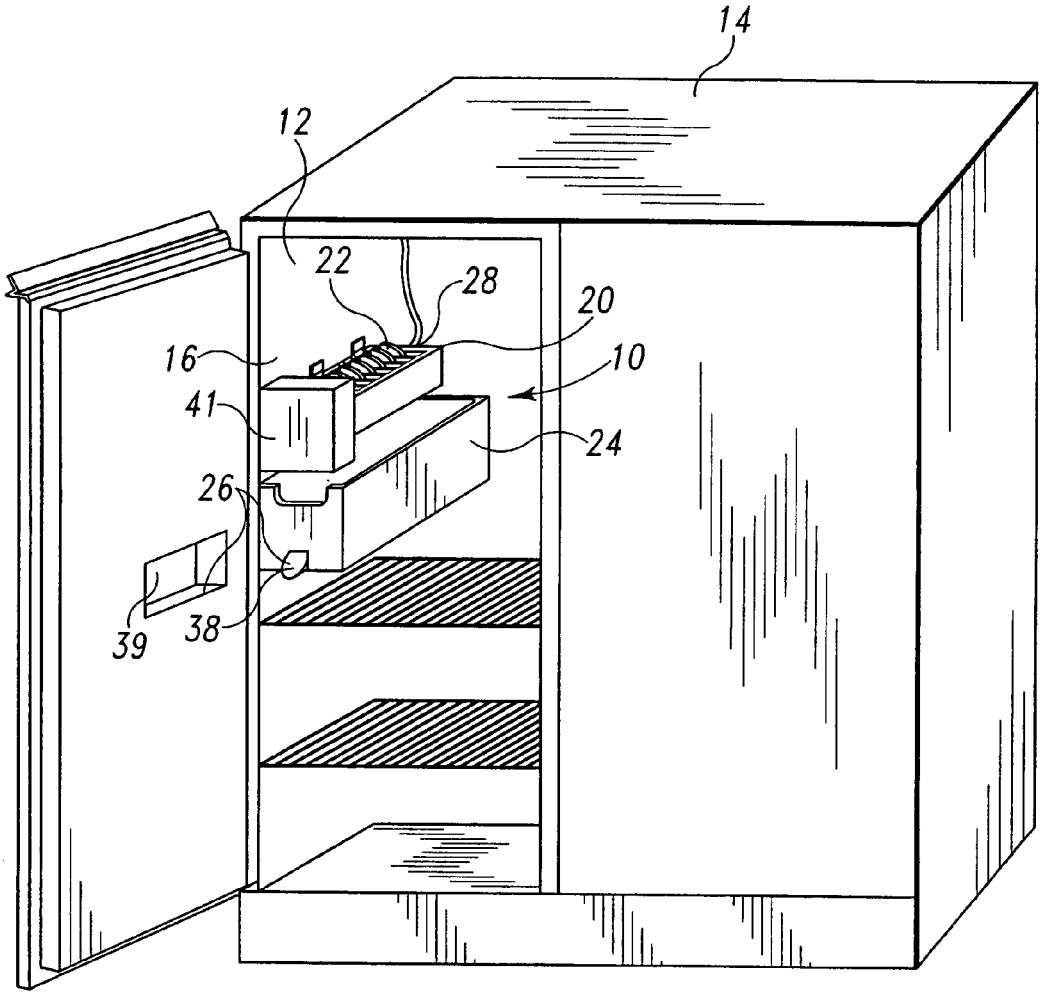
FIG. 1 is a perspective view of an icemaker mounted to the inside of a freezer compartment of a household side-by-side refrigerator/freezer showing an icemaker assembly including an ice tray, an ejector arm and a control box wherein a motor is mounted, a water inlet, and an ice bin.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

The disclosed icemaker assembly 10 eliminates ice webs or bridges between ice cubes by providing an ice tray 20 with compartments 66 having lateral side walls 100, 94 and 92, 102 of sufficient height to permit insertion of an object into each compartment 66 during or after filling and overflow of the compartment 66 and removal of the object from each compartment 66 after filling and overflow of the compartment 66. Each object has a volume such that when the object is removed from its corresponding compartment 66 the level of the water in the compartment 66 falls below the level at which it overflows the lateral side wall 94, 92 or an overflow channel 90 formed therein. Thus, the object acts as a displacement member 53.

The illustrated embodiments of the icemaker assembly 10 uses the ejector members 52 of the ejector arm 44, which are traditionally used to remove the ice cubes from the compartments 66, as the displacement members 53. By designing a volume shape on ejector members 52 of the ejector arm 44, either as a part of the primary ejector arm "finger", or as a separate set of fingers, the ejector members 52 of the ejector arm 44 may be disposed partially or completely in the compartments 66 during the filling process and removed prior to freezing to eliminate the ice web.

In operation, the water is allowed to fill the compartments 66 in the normal way. The ejector members 52 acting as displacement members 53 are introduced into the space 104 where the water is filling, displacing some volume of water so that the water spills over the walls 80 to adjacent compartments 66. These displacement members 53 may be introduced before, during or after the fill is initiated.

Once the displacement members 53 are removed, and a volume of water is no longer displaced, the level of the water in each compartment 66 falls below the overflow level of each compartment 66. Preferably a displacement member 53 is provided for insertion into each compartment and each displacement member 53 is substantially the same size and depth.

As shown, for example, in FIG. 1, the icemaker assembly 10 is incorporated in a freezer compartment 12 of a household side-by-side refrigerator/freezer 14. The illustrated refrigerator/freezer 14 includes a through-the-door ice and water dispenser. To facilitate through-the-door delivery of ice, the illustrated icemaker assembly 10 includes the ice tray 20, an ice ejector 22, an ice bin 24, an ice dispenser 26, a water inlet 28, and a controller 30. In the illustrated icemaker assembly 10, the water inlet 28 is in fluid communication with ice tray 20 so that water is added to ice tray 20. Water received in the ice tray 20 freezes and is removed from the ice tray 20 by ice ejector 22. Ice ejected from the ice tray 20 is received in the ice bin 24 where it is stored awaiting use. The ice bin 24 is formed to include a dispenser 26 from which ice is dispensed to the user.

In the illustrated embodiment of icemaker assembly 10, the dispenser 26 is a through-the-door ice dispenser. Thus, the ice bin 24 is configured to include a drive system of the dispenser 26 for driving ice cubes from the bottom of the ice bin 24 to a dispenser opening 38 communicating with a chute 39 communicating with the through-the-door ice outlet.

Figure 2:
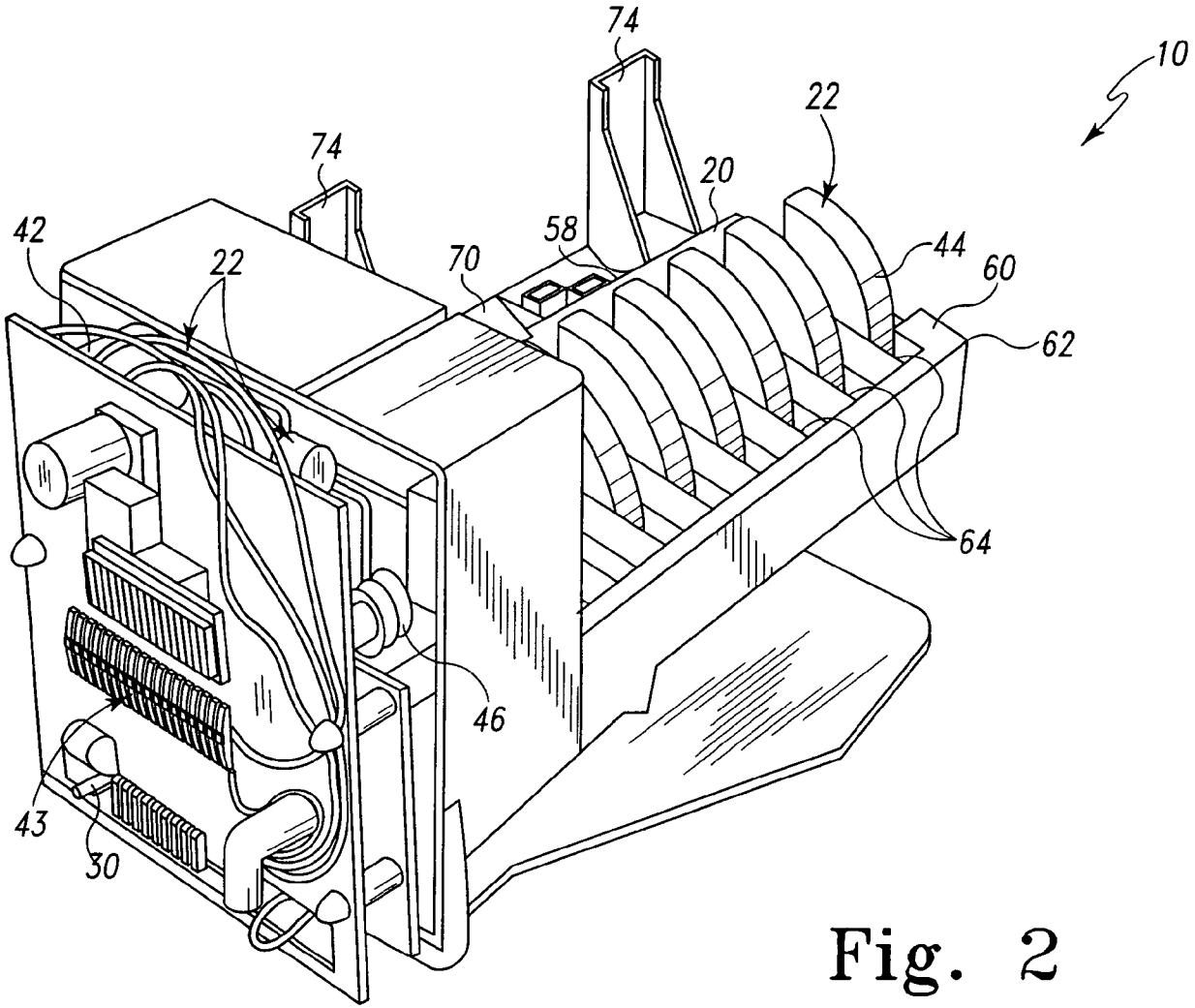
FIG. 2 is a perspective view of the icemaker assembly of FIG. 1 removed from the freezer compartment showing a cover removed from the control box to disclose a controller implemented in part on a PCB and a motor for rotating the ejector arm, the ejector members of which are shown partially inserted into compartments of the ice tray to act as displacement members.
Figure 3:
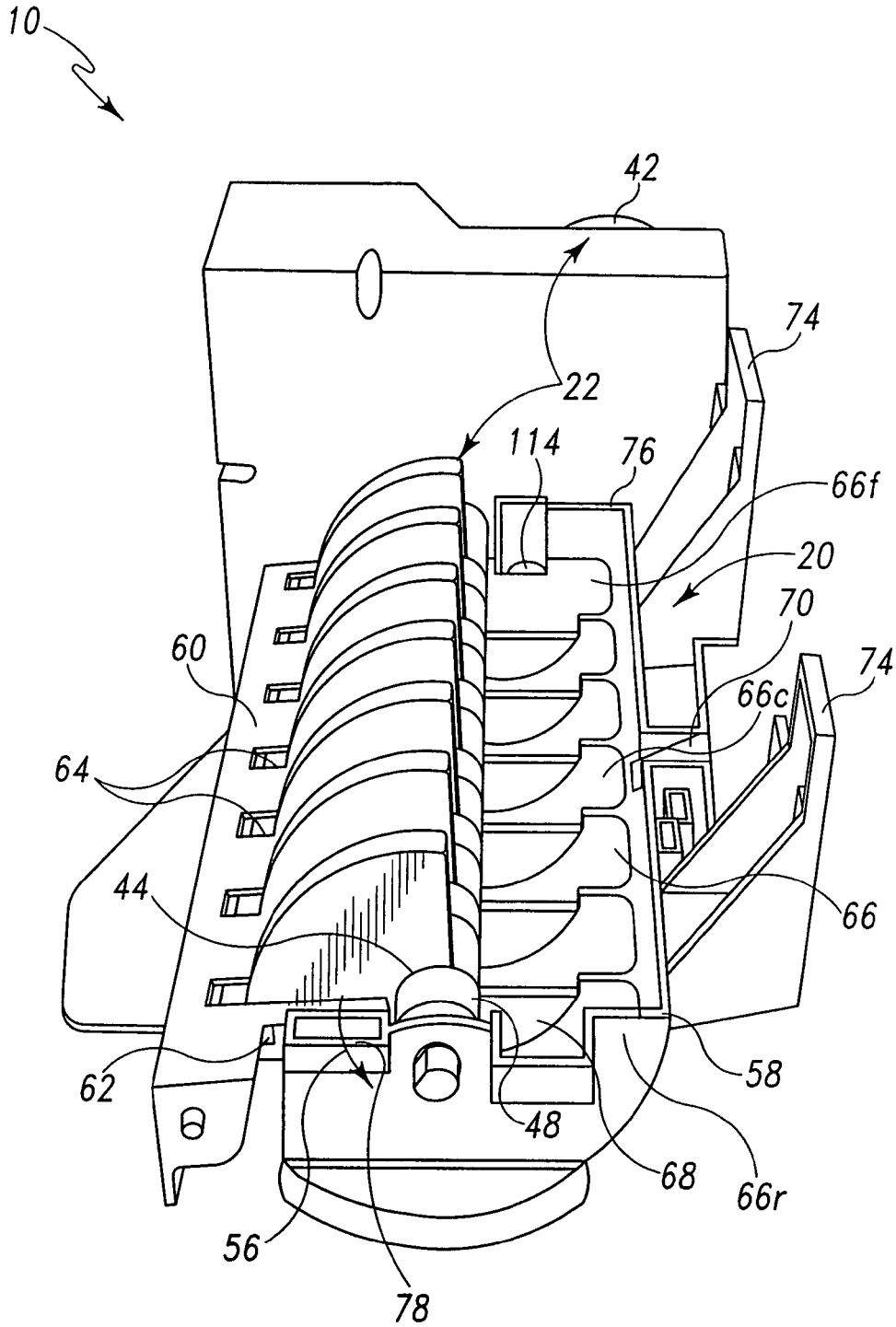
FIG. 3 a perspective view of the icemaker assembly of FIG. 2 showing the ejector arm and ice tray.
Figure 4:
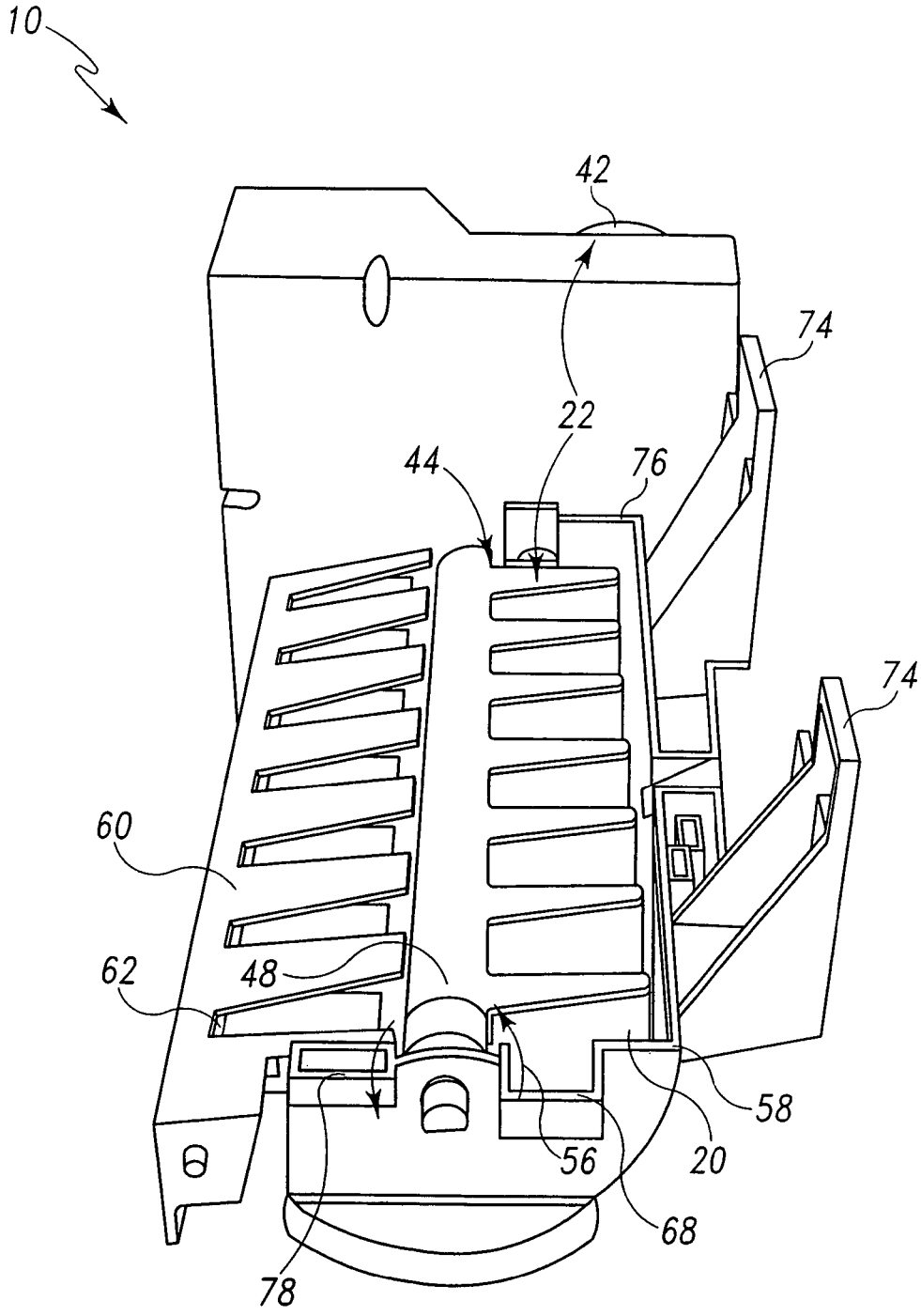
FIG. 4 is a perspective view of the ice tray and ejector arm of the icemaker in a first position wherein displacement members mounted to the shaft of the ejector arm are disposed within the ice forming compartments of the ice tray.

Referring now to FIGS. 2–9, the icemaker assembly 10 is shown removed from the freezer compartment 12 and in various states of disassembly. In FIG. 2, a cover 41 (FIG. 1) is removed from the icemaker assembly 10 to expose a circuit board 43 containing the controller 30. The ice ejector 22 includes a motor 42 having an output shaft, the ejector arm 44 and a drive train 46 coupling the output shaft of the motor 42 to the ejector arm 44.

Figure 5:
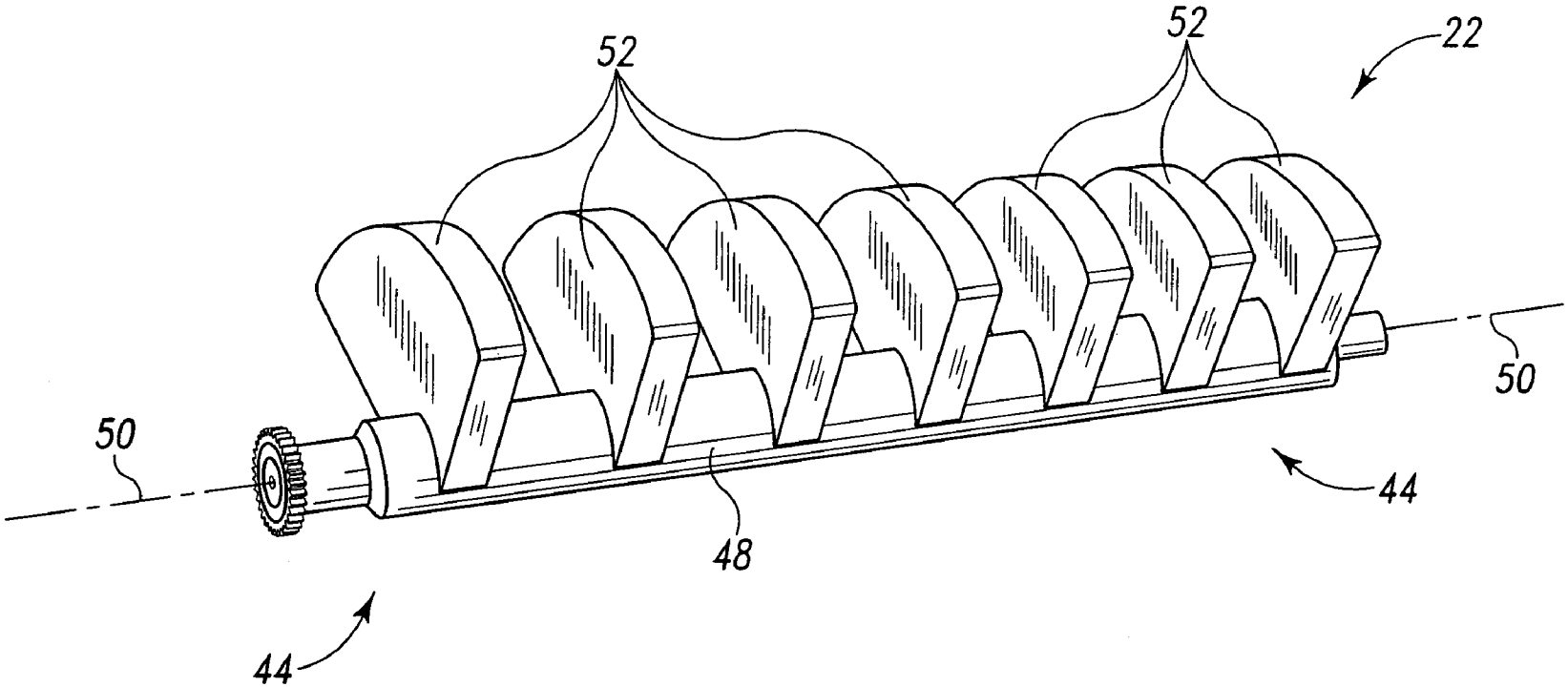
FIG. 5 is a perspective view of the ejector arm of the icemaker assembly of FIG. 2 showing seven displacement members mounted to a shaft configured to be rotated by the motor.
Figure 6:
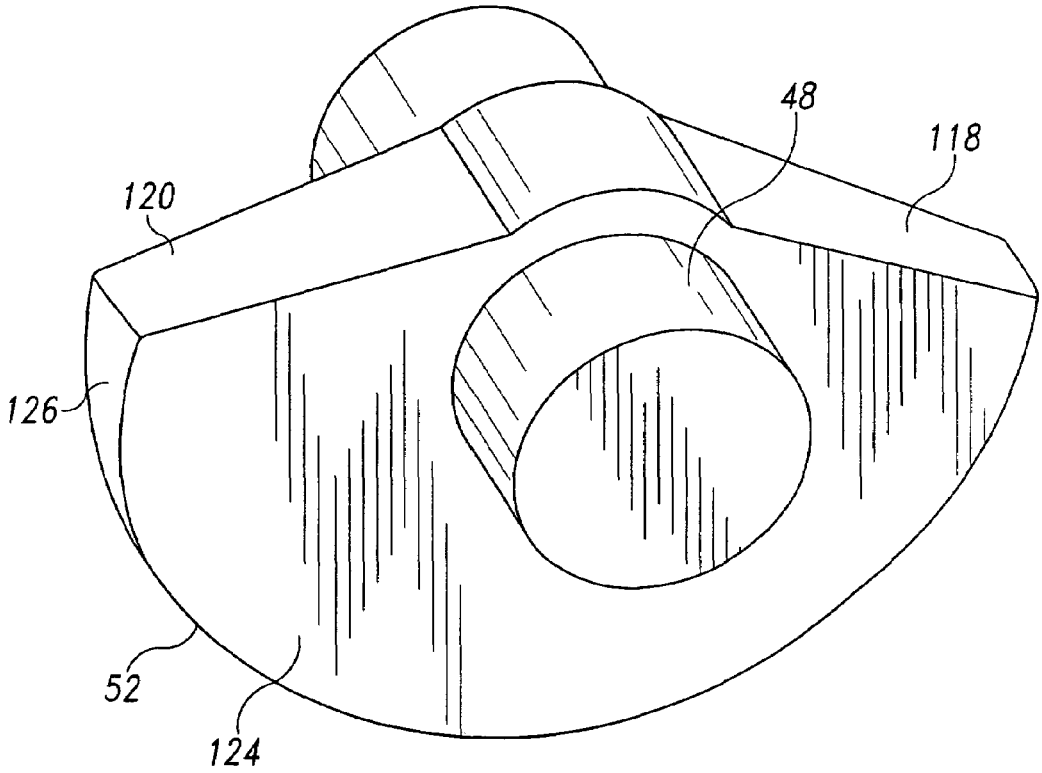
FIG. 6 is a perspective view of a single displacement member of the ejector arm of FIG. 5.
Figure 7:
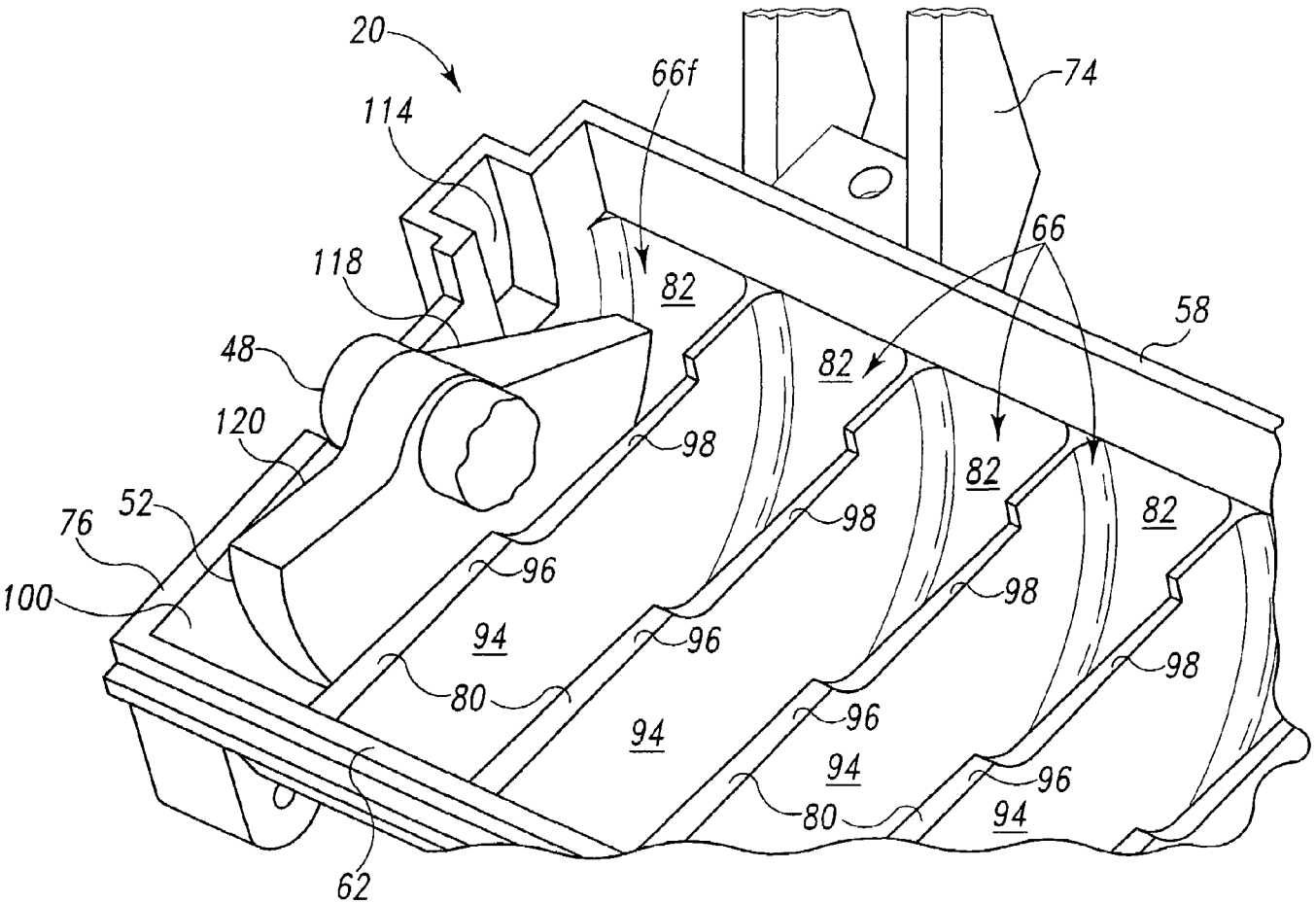
FIG. 7 is a perspective view of the front portion of the ice tray and ejector arm of FIG. 4 with parts broken away showing the overflow channels in divider walls between each adjacent crescent-shaped compartment and a displacement member disposed in the front compartment to facilitate overflow filling of the ice tray.

As shown, for example, in FIGS. 5–7, ejector arm 44 includes a shaft 48 formed concentrically about a longitudinal axis 50 and a plurality of ejector members 52 connected to and extending radially beyond the shaft 48. In the illustrated embodiment, the ejector members 52 are crescent-shaped fins and are configured to extend from the shaft 48 into the ice tray 20 when the shaft 48 is rotated.

In the illustrated embodiment, the entire ejector arm 44 is molded as a monolithic component including the shaft 48 and the plurality of ejector members 52. However, it is within the scope of the disclosure for the shaft 48 and each of the plurality of ejector members 52 to be formed as separate articles and for the plurality of ejector members 52 to be secured to the shaft 48 for rotation thereby.

As shown, for example, in FIGS. 6 and 7, each ejector member 52 includes a front face 118 and a rear face 120. Each ejector member 52 also includes a first side wall 122, a second side wall 124 and an outer wall 126 each extending between the front face 118 and the rear face 120. Outer wall 126 is illustratively configured as the sector of a cylinder formed concentrically about the axis 50 of the shaft 48 and extending between front face 118 and rear face 120.

In the illustrated embodiment, front face 118 and rear face 120 are each planar and are angularly displaced from each other by an angle 128. In the illustrated embodiment, the angle between front face 118 and rear face 120 is approximately one hundred ninety-five degrees. Those skilled in the art will recognize that angle 128 is not critical and can assume other values. However, when the ejector member 52 is utilized as a displacement member 53, angle 128 should be selected to ensure that ejector member 52 has sufficient volume to displace a desired amount of water.

Outer wall 126 is formed about a radius 129. Radius 129 is sufficient for a portion of the outer wall 126, when ejector arm 44 is properly oriented and mounted to rotate about rotation axis 91, to extend into the ice forming space 104 of a compartment 66 and be positioned vertically below the surface over which water overflows the compartment 66 (e.g. the top wall 98 of the overflow channel 90 or the top surface 1696 of the divider wall 1680) of ice tray 20. Illustratively, radius 129 is sufficient to place outer wall 126 over half way between the shaft 48 and the bottom wall 82 of the compartment 66 without engaging the bottom wall 82 of the compartment, as shown, for example, in FIGS. 10–15 when the ejector arm 44 is mounted for rotation about rotation axis 91. When ejector members 52 are utilized as displacement members 53, radius 129 should be large enough to ensure that each ejector member 52 has a sufficient volume that can be disposed in the ice forming space 104 to displace the desired volume of water when the ejector arm 44 is properly mounted and oriented.

The side walls 122, 124 extend radially outwardly from the shaft 48 to the outer wall 126. In the illustrated embodiment, walls 122, 124 form sectors of a convex cone that taper slightly inwardly, as shown, for example, in FIG. 6, as they extend radially from the shaft 48 to the outer wall 126. Thus, in the illustrated embodiment, the ejector member 52 is thinner near the outer wall 126 than near the shaft 48 as measured perpendicular to the rotation axis 91. As shown, for example, in FIGS. 2–3, the slots 64 in ice guiding cover 60 are configured to facilitate the passage of the ejector members 52 therethrough without contacting the cover 60 during rotation of the ejector arm 44 about the rotation axis 91. Thus, ejector members 52 have a width, measured perpendicular to the rotation axis, that in the illustrated embodiment narrows as the side walls 122, 124 extend radially from the shaft 48 to the outer wall 126.

It is within the scope of the disclosure for side walls 122, 124 to be planar and oriented to be perpendicular to the rotation axis 91, so that the ejector members 52 have a uniform width, or to be sectors of a concave cone so as to taper outwardly, so that the ejector members 52 have an increasing width, as the side walls 122, 124 extend from the shaft 48 to the outer wall 126. The width of each ejector members 52 should be less than the narrowest width of the compartment 66 through which it must pass during rotation of the ejector arm 44 about the rotation axis 91. When ejector members 52 are utilized as displacement members 53, as described herein, the configuration of side walls 122, 124 and width of ejector member 52 should be selected to ensure that each ejector member 52 has a sufficient volume that can be disposed in the ice forming space 104 to displace the desired volume of water when the ejector arm 44 is properly mounted and oriented.

Those skilled in the art will recognize that ejector members 52 may assume other configurations than those described above and still serve the purpose of acting as an ejector member 52 and a displacement member 53. Also, even though the illustrated embodiments of icemaker assembly 10 show the ejector members 52 of the ejector arm 44 being configured and utilized to act as both ejector members 52 for ejecting ice cubes and displacement members 53 for displacing water during the filling process, it is within the scope of the disclosure for water to be displaced during the filling process in other ways and by other devices. For instance, it is envisioned that the ejector arm 44 may be configured to include distinct ejector members and displacement members each extending radially from the shaft 48 but angularly displaced from one another. It is also within the scope of the disclosure for a mechanism to be provided for disposing displacement members into the ice forming space 104 during the filling process that is not rotated by the shaft 48 of the ejector arm 44.

It is within the scope of the disclosure for ejector members 52 to be fingers, shafts or other structures extending radially beyond the outer walls of shaft 48. Rotation of the output shaft of the motor 42 is transferred through the drive train 46 to induce rotation of the ejector arm 44 about its longitudinal axis 50.

Figure 9:
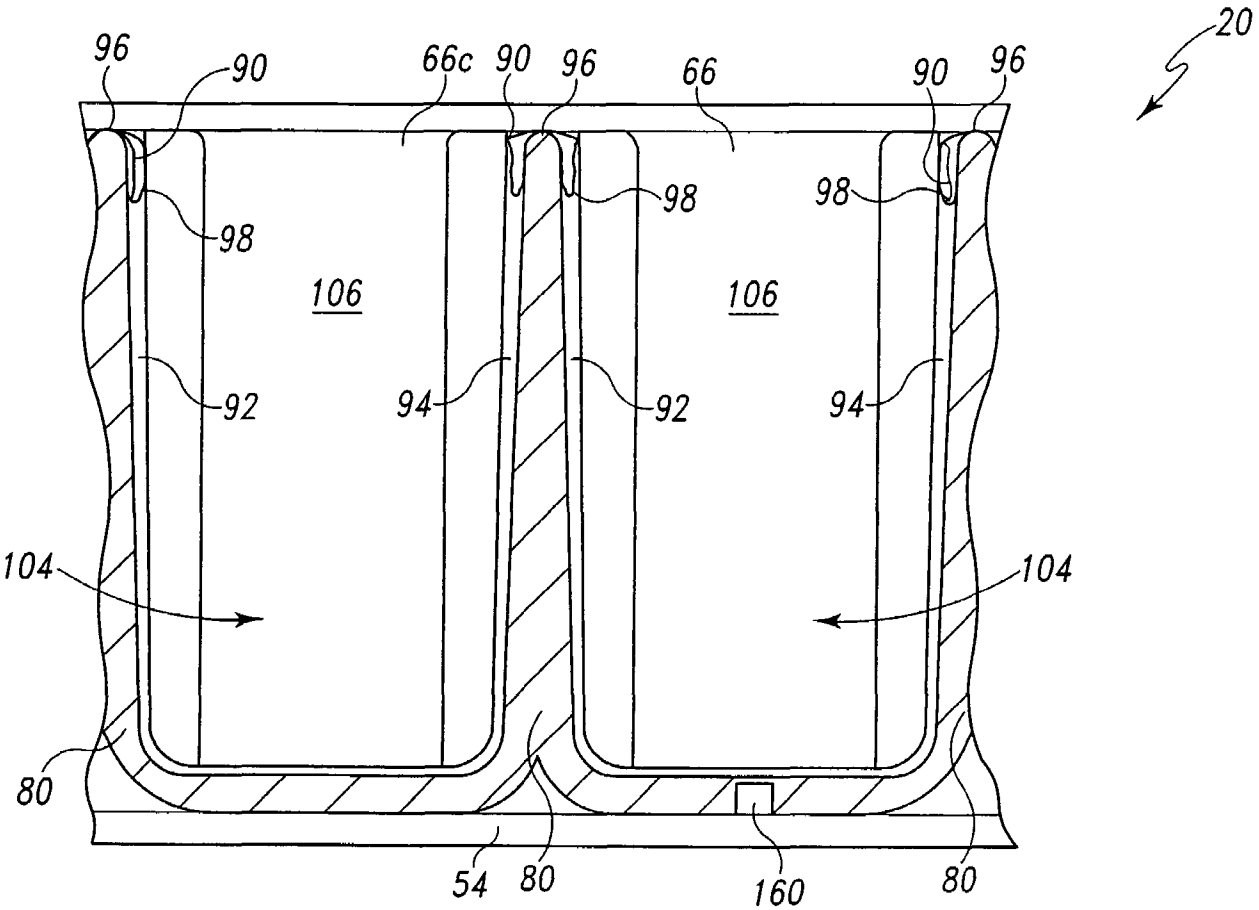
FIG. 9 is a sectional view of the ice tray taken along line 9—9 of FIG. 8 which also shows a heater disposed below the ice tray.

Controller 30 includes a microcontroller, sensors and a timer to control the motor 42 and ice tray heater 54 (FIG. 9). In the illustrated embodiment, motor 42 may be a stepper motor such as a Series LSD42 direct drive, 4 phase bifilar, stepping motor available from Hurst Manufacturing, a part of Emerson Motor Company, St. Louis, Mo. When such a motor is utilized, the controller 30 includes a stepper motor controller configured to control the rotational movement of the motor 42 by energizing the coils to start, stop and reverse the direction of the motor 42, as more particularly described hereafter in the description of FIGS. 10–15. The disclosed stepper motor is supplied with four wires (white, blue, red and black) for energizing the coils of the motor 42. The controller 30 induces clockwise rotation by energizing the white and blue wires, white and red wires, black and red wires and black and blue wires in a cyclical fashion. The controller induces counter-clockwise rotation by energizing the black and blue wires, black and red wires, white and red wires and white and blue wires in a cyclical fashion. Stepper motor controller may be implemented on a separate integrated circuit, such as a Model 220001 stepper motor controller available from Hurst Manufacturing or the like, in the microprocessor or microcontroller or through separate logic circuitry within the scope of the disclosure.

In another embodiment, motor 42 is a unidirectional synchronous motor such as a permanent magnet synchronous speed gear motor available from Mallory Controls, a Division of Emerson, Indianapolis, Ind. Such a motor has a constant rotor speed proportional to the frequency of the AC power supply. When such a motor is utilized, controller 30 rotates the ejector to submerge the entire ejector member 52 or a portion of the ejector member 52 adjacent the front face 118 or rear face 120 in the compartment 66 to act as displacement members 53 during a filling cycle. In one current embodiment of icemaker assembly 10, a unidirectional motor 42 is stopped during filling to dispose the entire ejector member 52 in the cavity, as shown, for example, in FIG. 10, to displace water so that a minimum sized ice cube can be formed. Such a unidirectional motor can be stopped during filling to dispose a portion adjacent the front face 118 of the ejector member 52 in the cavity, as shown, for example, in FIG. 14, to form a larger ice cube. Alternatively, such a unidirectional motor can be stopped during filling to dispose a portion adjacent the rear face 120 of the ejector member 52 in the cavity, as shown, for example, in FIG. 15, to form a larger ice cube. Those skilled in the art will recognize that the ejector member 52 can be stopped in other positions than those illustrated to form ice cubes of various sizes.

Figure 11:
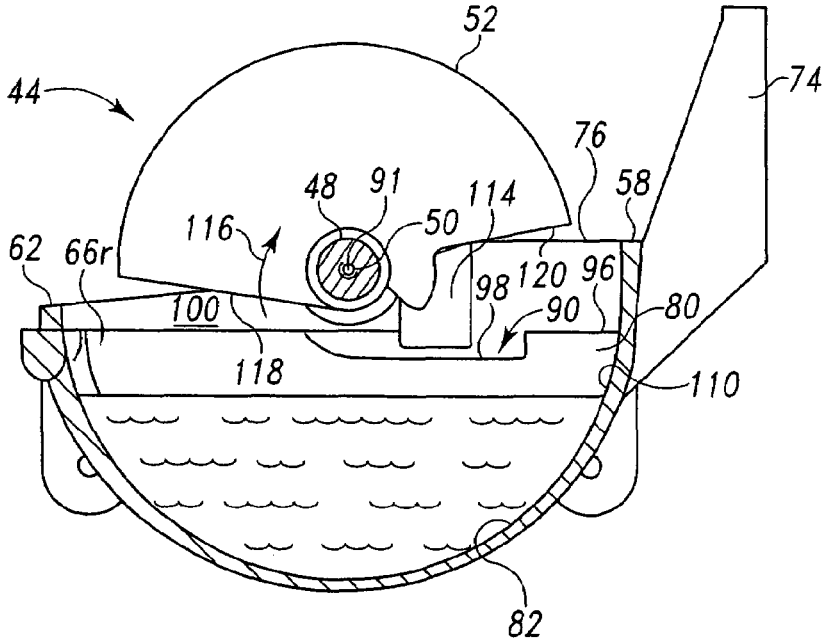
FIG. 11 is a sectional view similar to FIG. 10 following removal of the ejector member from the ice forming space of the compartment and prior to ice forming in the compartment showing how the water level falls below the level of the overflow channel to eliminate formation of an ice bridge between adjacent cubes.

In the illustrated embodiment in which the ejector members 52 are used as both displacement members 53 and stirrers, the controller 30 controls the motor 42 so that rotation of the ejector arm 44 is stopped with the ejector members 52 disposed completely outside the ice forming space 104 of each compartment 66, as shown, for example, in FIG. 11, for a period of time to permit water to freeze in the ice tray 20. Once the water is frozen in the ice tray 20, controller 30 enables motor 42 to drive the ejector arm 44 in the direction of arrow 56 in FIGS. 3, 4, 12, 14, 15 causing ice in the tray 20 to be forced out of the ejection side 58 of the tray 20. In the illustrated embodiment, ejection side 58 of the tray 20 is the side of the tray 20 adjacent the side wall 16 of the freezer compartment 12 to which the ice maker assembly 10 is mounted.

The controller 30 controls the motor 42 to position a portion of the displacement member 53 in the ice forming compartment 66 at some time during the filling operation. Prior to freezing, the controller 30 again drives the motor 42 so that rotation of the ejector arm 44 is stopped with the ejector members 52 disposed completely outside the ice forming space 104 of each compartment 66 for a period of time to permit water to freeze in the ice tray 20. Once the water is frozen in the ice tray 20, controller 30 enables motor 42 to drive the ejector arm 44 in the direction of arrow 56 in FIGS. 3, 4 and 12 causing ice in the tray 20 to be forced out of the ejection side 58 of the tray 20. In the illustrated embodiment, ejection side 58 of the tray 20 is the side of the tray 20 adjacent the side wall 16 of the freezer compartment 12 to which the icemaker assembly 10 is mounted.

An ice guiding cover 60 extends inwardly from the outside 62 of the tray 20 and is configured to include slide fingers 63 with slots 64 formed therebetween to permit the ejector members 52 of the ejector arm 44 to extend through slots 64 in the cover 60 into the ice tray 20. Ice cubes ejected from ejection side 58 of the tray 20 fall onto the slide fingers 63 of the cover 60 and slide off of the outer edge of the cover 60 into the ice bin 24.

Figure 8:
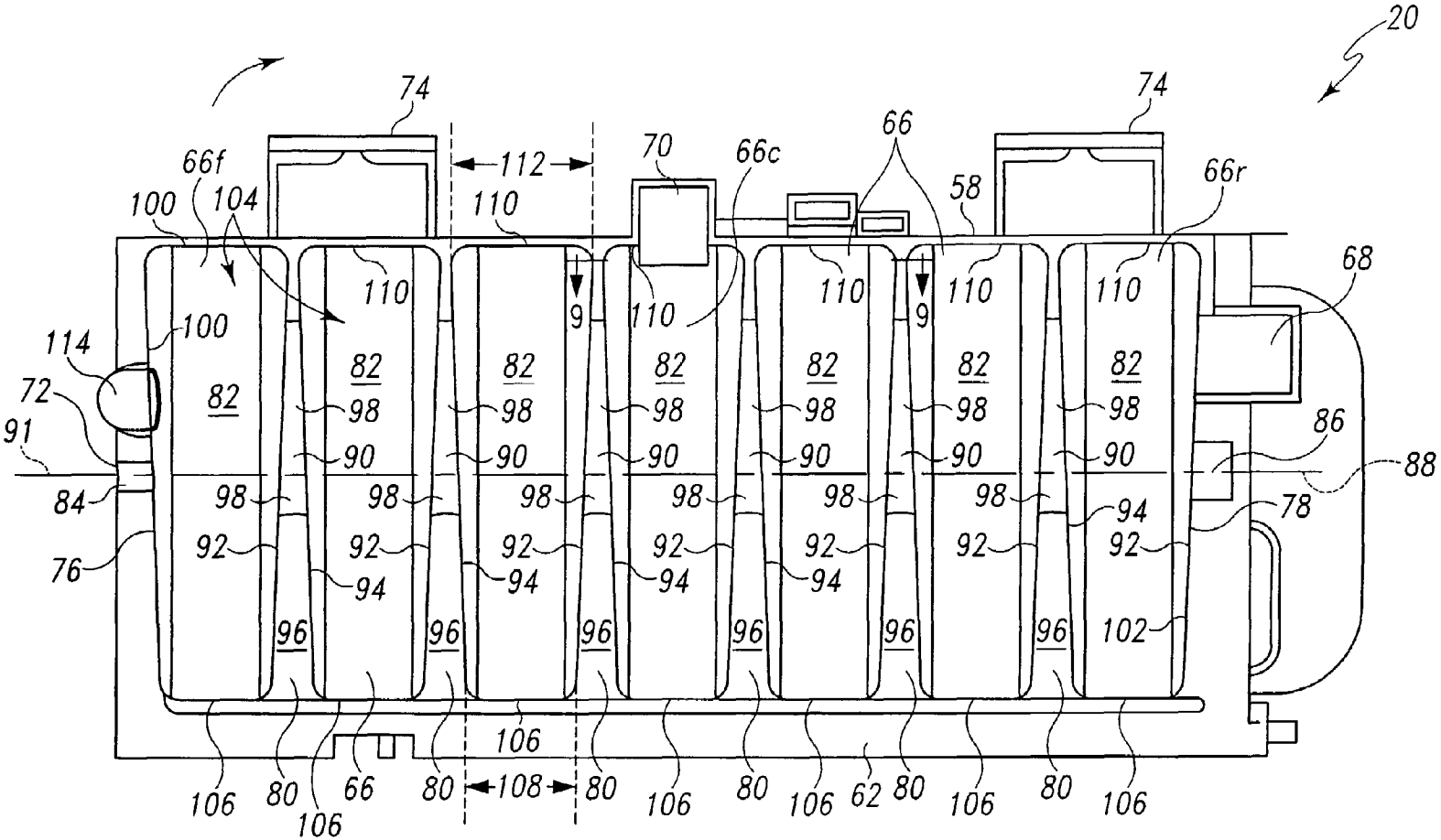
FIG. 8 is a plan view of the ice tray of FIG. 4 showing the configuration of the divider walls between adjacent crescent-shaped compartments.

As shown, for example, in FIGS. 7–9, ice tray 20 is formed to include seven tapered crescent-shaped compartments 66, an end water inlet ramp 68, a side water inlet ramp 70, ejector arm mounting features 72, and mounting brackets 74. Tray 20 includes a first end wall 76, a second end wall 78, a plurality of partitions or divider walls 80 and a plurality of floor walls 82 that cooperate to form the ice forming compartments 66. In the illustrated embodiment, as shown in FIG. 1, the end water inlet ramp 68 is formed in the second end wall 78 to be positioned below the water inlet 28 to facilitate filling the seven compartments 66 using the overflow method. The side water inlet ramp 70 is provided for those refrigerator/freezers 14 that position the water inlet along the mounting wall 16 of the freezer compartment 12. Water inlet ramps communicating with an ice forming compartment 66 may be formed in other locations on the tray within the scope of the disclosure.

The ejector mounting arm features 72 include a shaft-receiving semi-cylindrical bearing surface 84 formed in the first end wall 76, a shaft-receiving semi-cylindrical bearing surface 86 formed in the second end wall 78, a shaft-receiving aperture 88 formed through the second end wall 78, and portions of each of a plurality of overflow channels 90 formed in each divider wall 80. The shaft-receiving semi-cylindrical bearing surfaces 84, 86 and the shaft-receiving aperture 88 are formed concentrically about the rotation axis 91 of the shaft 48 of the ejector arm 44. The shaft-receiving semi-cylindrical bearing surfaces 84, 86, the shaft-receiving aperture 88 and the portions of the overflow channels 90 are sized to receive the shaft 48 of the ejector arm 44 for free rotation therein. The shaft-receiving semi-cylindrical bearing surfaces 84, 86, the shaft-receiving aperture 88 and the portions of the overflow channels 90 are positioned to permit the longitudinal axis 50 of the shaft 48 of the ejector arm 44 to coincide with the rotation axis 91 when the ejector arm 44 is received in the tray 20 and rotated by the motor 42 and drive train 46.

In the illustrated embodiment, mounting brackets 74 extend from the ejection side 58 of the ice tray 20 to facilitate mounting the tray 20 to the mounting side wall 16 of the freezer compartment 12. It is within the scope of the disclosure for other mounting features to be present on the tray 20 and for those mounting features to facilitate mounting of the tray 20 to other structures within the freezer compartment 12.

As mentioned above, each partition or divider wall 80 extends laterally, relative to longitudinal axis 50, across the ice tray 20. In the illustrated embodiment, each divider wall 80 includes a forwardly facing lateral side surface 92, a rearwardly facing lateral side surface 94 and a top surface 96. The forwardly facing lateral side surface 92, rearwardly facing lateral side surface 94 and top surface 96 are formed to include an overflow channel 90. Each overflow channel 90 includes a top wall 98 positioned below the top surface 96 of the divider wall 80. The top wall 98 of the overflow channel 90 is positioned near the desired maximum fill level of each compartment 66. The first end wall 76 includes a rearwardly facing lateral side surface 100. The second end wall 78 includes a forwardly facing lateral side surface 102.

In the illustrated embodiment, water from the water inlet 28 flows down the end water inlet ramp 68 into the rear ice forming compartment **66*r*. The water enters and fills the rear ice forming compartment 66*r* until the level reaches the level of the top wall 98 of the overflow channel 90 and then overflows into the compartment 66 adjacent the rear compartment 66***r*. After water fills each compartment 66 it overflows through the overflow channel 90 into the adjacent compartment 66. When the water in all of the compartments 66 has reached a desired level, water flow stops.

The overflow method can also be used to fill all of the compartments 66 of the ice tray 20 when water first flows into the center compartment 66*c*, into which the side water inlet ramp 70 flows, when the water inlet is mounted to the mounting side wall 16 of the freezer compartment 12. When water first enters the tray 20 through the side water inlet ramp 70, the water overflows in both directions to fill each compartment 66 of the tray 20.

Figure 23:
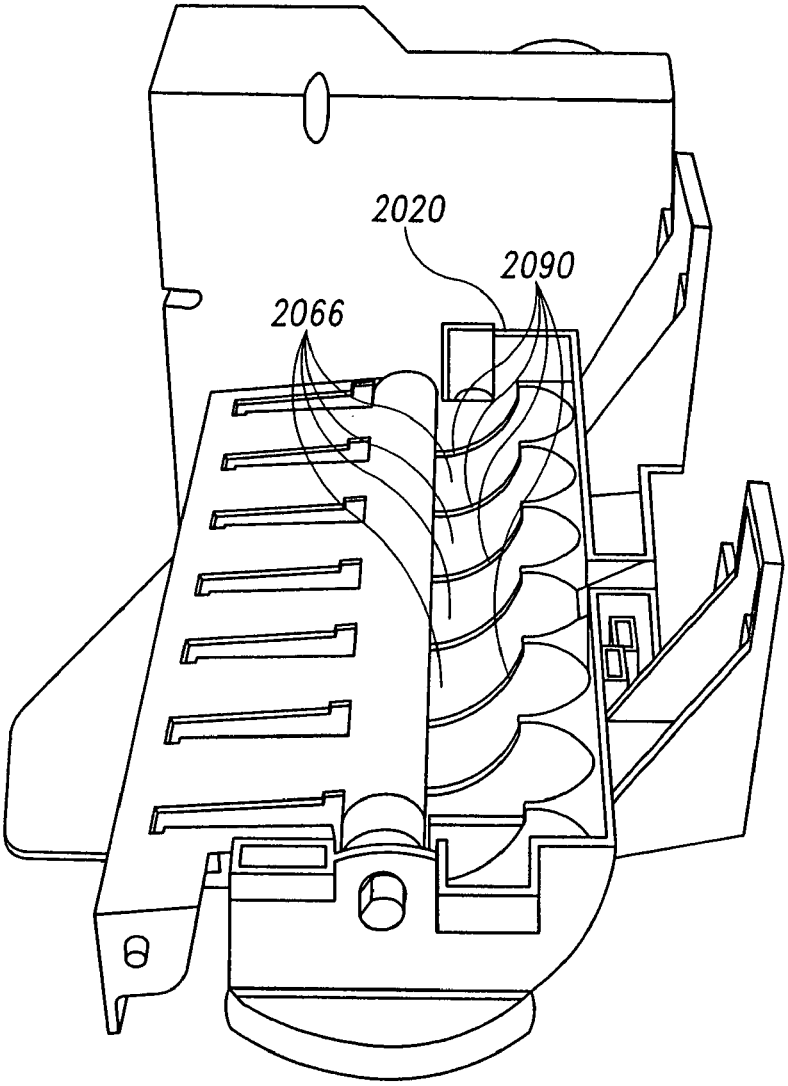
FIG. 23 is a perspective view of a prior art icemaker assembly showing weirs formed in divider walls between compartments of the ice tray.

Using the overflow method of filling the ice tray 20 might result in an ice bridge or web forming between the ice cubes in the area of the overflow channel 90 if water is not displaced from each compartment 66 during the filling process. Some prior art icemakers, as shown, for example, in FIG. 23, include trays 2020 having much deeper channels or weirs 2090 formed in divider walls 2080 to facilitate filling of all of the compartments 2066. These prior art weirs 2090 result in the formation of a much thicker ice bridges than could be formed in the present tray even if water were not displaced during filling.

The presence of the ice bridge may increase the torque that the ejector arm 44 must exert to eject the ice cubes from the tray. Since it is desirable to reduce this torque, the present ice tray 20 seeks to eliminate the ice bridge by positioning the overflow channel 90 above the desired maximum fill level. While the full benefits of the disclosed ice tray 20 will not be recognized, it is within the scope of the disclosure to position the overflow channel 90 below, but near to, or at, the maximum fill level to totally eliminate the ice bridge in many ice cubes that are not the maximum size that can be produced and minimize the ice bridge in maximum sized ice cubes that can be produced.

As shown, for example, in FIGS. 7–15, each compartment 66 of ice tray 20 is configured to include a space 104 in which a tapered crescent-shaped ice cube 130 is formed. In the illustrated embodiment first end wall 76 includes a planar lateral side surface 100 and second end wall 78 includes a planar lateral side surface 102. Each partition member or divider wall 80 includes a top surface 96 and two downwardly extending oppositely facing lateral side surfaces 92, 94. The forwardly facing planar lateral side surface 102 of the second end wall 78, the rearwardly facing planar lateral side surface 94 of the divider wall 80 adjacent the second end wall 78 and the arcuate bottom surface or floor wall 82 cooperate to define a space 104 in the rear compartment 66*r* in which ice is formed. Similarly, the rearwardly facing planar lateral side surface 100 of the first end wall 76, the forwardly facing planar lateral side surface 92 of the divider wall 80 adjacent the first end wall 76 and the arcuate bottom surface 82 cooperate to define a space 104 in the front compartment 66*f* in which ice is formed. The spaces 104 in which ice is formed in the intermediate compartments 66 are defined by the rearwardly facing planar lateral side surface 94 of a divider wall 80, the forwardly facing planar lateral side surface 92 of the adjacent divider wall 80 to the rear of the first divider wall 80 and the arcuate bottom surface 82. Thus the ice forming space 104 in each compartment 66 includes a first planar lateral side surface 100 or 94, a second planar lateral side surface 102 or 92, and an arcuate bottom surface 82 interposed between the first lateral side surface 100 or 94 and the second lateral side surface 102 or 92.

As show, for example, in FIGS. 7–9, each compartment 66 is substantially identical. In each compartment 66, one planar lateral side surface 100, 94, from an end wall 76 or a divider wall 80, respectively, is positioned relative to a second planar lateral side surface 92, 102, from an adjacent divider wall 80 or end wall 78, respectively, so that the first planar lateral side surface 100, 94 is spaced apart from the second planar lateral side surface 92, 102 at a downstream end 106 by a distance D1 108 relative to an ejection path of movement. As mentioned previously, the ejection path of movement in the illustrated icemaker assembly 10 is laterally across the ice tray 20 from the outside 62 of the ice tray 20 to the ejection side 58 of the ice tray 20. Thus, as used herein, the downstream end 106 is adjacent the outside 62 of the tray 20. Therefore, adjacent the outside 62 of the tray, the first planar lateral side wall 100, 94 of each compartment 66 is spaced apart from the second planar lateral side surface 92, 102 by the distance D1 108.

In each compartment 66, the first planar lateral side surface 100, 94 is spaced apart from the second planar lateral side surface 92, 102 at an upstream end 110 of the compartment 66 by a distance D2 112 relative to said ejection path of movement.

In the illustrated embodiment, each lateral side surface 92, 94, 100, 102 is planar, except for a bottom portion that smoothly curves into the bottom surface 82 to facilitate formation of the ice tray 20 using a molding process. As in prior art ice trays, the width of the compartment 66 may be narrower near the bottom and wider near the top, as shown, for example, in FIG. 9, to facilitate formation of the ice tray 20 using a molding process. The disclosed ice tray forms tapered crescent-shaped ice cubes 130 which facilitate harvesting of the ice cubes by reducing heating of the tray prior to ejection. The tapered crescent-shaped ice cubes 130 and compartments 66 reduce torques exerted on the motor 42, ejector arm 44 and drive train 46 during ejection and reduce ice chips which may be formed by forcing wider sections of an ice cube through narrower sections of a compartment during ejection. Such an ice tray 20 is more particularly described in U.S. patent application Ser. No. 10/895,570, entitled Method and Device for Producing Ice Having a Harvest-facilitating Shape, which is assigned to the same assignee as the present invention, and which is filed concurrently herewith, the disclosure of which is hereby incorporated by reference in its entirety.

An ice cube 130 formed in a space 104 in an illustrated compartment 66 of the ice tray 20 has an external shape conforming on three surfaces to the lateral side surfaces 92, 102 and 100, 94, respectively, and bottom surface 82 of the compartment 66. On the top surface 132, the ice cube 130 is substantially flat. The top surface 132 may include an upwardly extending central bulge (not shown) formed as a result of the ice forming process. A method to eliminate this central bulge is described in U.S. patent application Ser. No. 10/895,665, entitled Method and Device for Stirring Water During Icemaking, which is assigned to the same assignee as the present invention, the disclosure of which is hereby incorporated by reference in its entirety.

The ice cube 130 includes a first lateral side wall and oppositely facing second lateral side wall and an arcuate shaped bottom wall 138 extending between the first and second lateral side walls. The ice cube 130 has a narrow end 140 having a width substantially equal to the distance D1 108 and a wide end 144 having a width substantially equal to the distance D2 112.

Except where they merge with bottom wall 138, side walls of the ice cube 130 are substantially planar as a result of the ice conforming to the shape of the lateral side surfaces 100, 94 and 92, 102 of the compartment 66. The distance between lateral side walls at any level of the cube 130 increases slightly from bottom to top as a result of conforming to the lateral side surfaces 100, 94 and 92, 102 of the ice forming compartment 66 which are configured to facilitate formation of the ice tray 20 using a molding process. The distance between lateral side walls of the ice cube 130 increases asymptotically from the narrow end 140 to the wide end 144.

Although described and illustrated as being planar, it is within the scope of the disclosure for lateral side surfaces 100, 94 and 92, 102 of the compartment 66 to have other configurations such as being arcuate shaped. Preferably, the distance between oppositely facing lateral side surfaces 100, 94 and 92, 102 of a compartment 66 increases asymptotically in relation to the ejection path of movement.

While described and illustrated as having the same configuration, it is within the scope of the disclosure for each compartment 66 to have differing configurations. For example, it is within the scope of the disclosure for one compartment 66 to include a planar lateral side surface, an oppositely facing arcuate lateral side surface and an arcuate bottom surface while another compartment 66 includes two oppositely facing planar lateral side surfaces and a sloped bottom surface. Various combinations of lateral side surface and bottom surfaces may be used to define a compartment 66.

In use, water is released from the water inlet 28 and flows down the end water inlet ramp 68 into the rear compartment 66*r*. During the filling process, a portion of each ejector member 52 is disposed in the ice forming space 104 of its associated compartment as shown, for example, in FIGS. 10, 14 and 15. When sufficient water has entered the rear compartment 66*r* to raise the level of the water in the compartment 66*r* to the level of the top surface 98 of the overflow channel 90, water overflows into the adjacent compartment 66 until the adjacent compartment 66 overflows into its adjacent compartment 66. This fill and overflow process continues until water has filled each compartment 66. The water filling operation may be based on a set time that is calibrated to ensure proper filling of all of the compartments 66 of the tray 20 or the level of the water in the last compartment 66*f* to be filled may be sensed.

In the illustrated embodiment, a fill level reservoir 114 is formed in the first end wall 76 of the front compartment 66*f*. Water flows into the fill level reservoir 114 when each compartment 66 is filled to the desired level. A sensor (not shown) in the fill level reservoir 114 senses the presence of water and sends a signal to the controller 30 to stop the filling operation. Cessation of the filling operation may be accomplished in various ways, however, the illustrated icemaker assembly 10 closes a solenoid valve (not shown) positioned between the water source (not shown) and the water inlet 28 to stop the filling operation.

Figure 10:
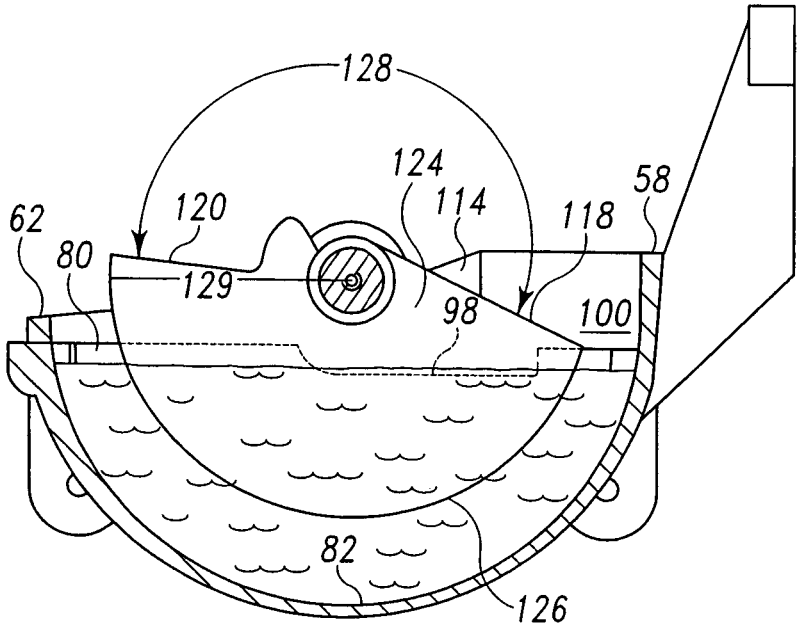
FIG. 10 is a sectional view of the ice tray and ejector arm taken through the rear compartment adjacent the rear end wall looking toward the front end wall during the fill operation showing the ejector arm positioned as shown in FIG. 7 with an ejector member extending into the ice forming space of the compartment to act as a displacement member for displacing water that is flowing over the overflow channel.
Figure 15:
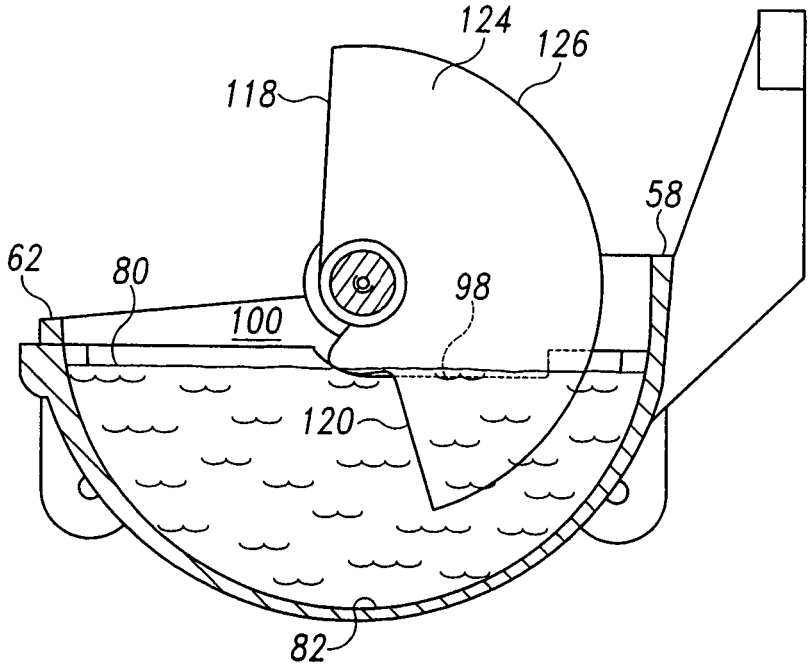
FIG. 15 is a sectional view similar to FIG. 10 showing a rear portion of the ejector member disposed in the ice forming compartment to displace less water than when the ejector member is positioned as shown in FIG. 10 to permit larger ice cubes to be formed in the compartment.
Figure 14:
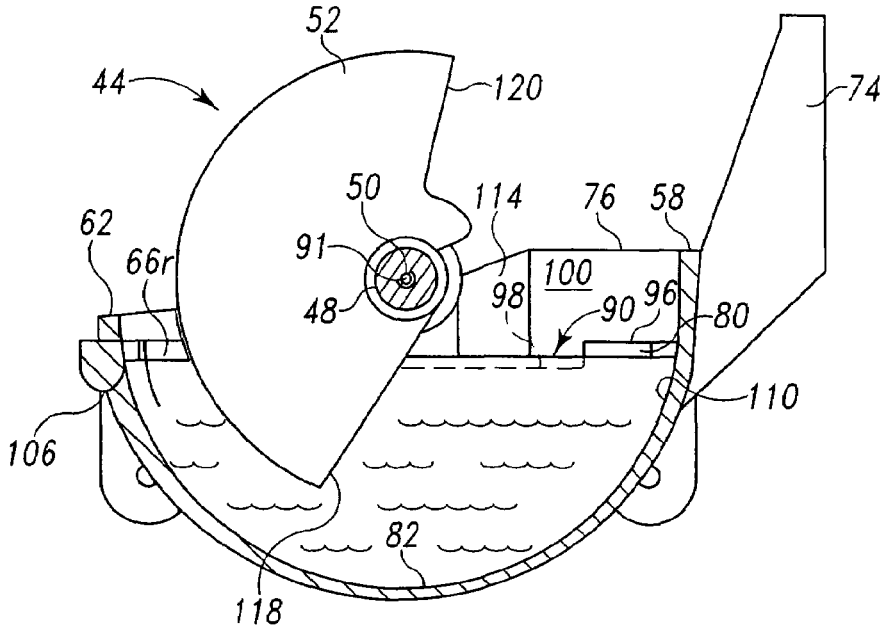
FIG. 14 is a sectional view similar to FIG. 10 showing a front portion of the ejector member disposed in the ice forming compartment to displace less water than when the ejector member is positioned as shown in FIG. 10 to permit larger ice cubes to be formed in the compartment.

In the illustrated embodiment, following the previous ice ejection operation, the ejection arm 44 is rotated so that a portion of the ejector member 52 is disposed in each compartment 66, as shown, for example, in FIGS. 10, 14 and 15, to act as a displacement member 53. This portion of the ejector member 52 displaces water in the compartment 66 inducing overflow of the water prior to there being a sufficient volume of water alone to cause overflow of the compartment 66. When positioned as shown in FIG. 10, the ejector member 52 acts as a displacement member 53 that displaces the maximum amount of water during the filling operation resulting in the production of a minimum sized ice cube. When positioned as shown in FIGS. 14 and 15, ejector member 52 acts as a displacement member 53 that displaces less water during the filling process resulting in a larger ice cube being formed. Those skilled in the art will recognize that the size of the ice cube to be formed can be controlled by controlling the volume of the displacement member 53 positioned in the ice forming space 104 of the compartments 66. This can be controlled by controlling the angular position of the ejector arm 44.

Once the sensor in fill level reservoir 114 senses the presence of water, the flow of water into the ice tray 20 is stopped. At some time prior to the water freezing in each compartment 66, the ejector arm 44 is turned until the entire displacement member 53 is disposed outside of the ice forming space 104 in each compartment 66, as shown, for example, in FIG. 11.

When the maximum amount of the ejector member 52 is disposed in the ice forming space 104 during filling, as shown, for example, in FIG. 10, the ejector arm 44 may be rotated in the direction of arrow 56 or in the opposite direction, as indicated by arrow 116 in FIG. 11, to remove the ejector member 52 from the ice forming compartment. When a portion adjacent the front face 118 of the ejector member 52 is disposed in the ice forming space 104 during the filling process, the ejector arm 44 may be rotated in the direction of arrow 116 to remove the ejector member 52 from the compartment 66 to avoid a hyper-overfill situation. When a portion adjacent the rear face 120 of the ejector member 52 is disposed in the ice forming space 104 during the filling process, the ejector arm 44 may be rotated in the direction of arrow 56 to remove the ejector member 52 from the compartment 66 to avoid a hyper-overfill situation. However, even if a hyper-overfill situation is created by rotation of the ejector arm 44 in the opposite direction from that indicated above, the water level in the ice forming spaces 104 should return to below the top wall 98 of the overflow channel 90 in each compartment 66 following removal of the ejector member 52 from the ice forming space 104.

In the illustrated embodiment of icemaker system 10, a reversible motor 42 may be used to facilitate stirring the water prior to freezing. When such a reversible motor is used, rotation of the ejector arm 44 in either direction 56, 116 is permitted. However, from the above description, those skilled in the art will recognize that a motor 42 capable of turning in only a single direction may be utilized within the scope of the disclosure to eliminate ice bridges between cubes.

Once the displacement member 53 is removed from the ice forming space 104, the level of the water in each compartment 66 falls to a level below the top surface 98 of the overflow channel 90 so that no water remains in the overflow channel 90 to form an ice bridge.

It is within the scope of the disclosure for the ejector arm 44 to be rotated in either direction 56, 116 following a previous ejection cycle to position a portion of the ejector member 52 in the ice forming space 104 to act as a displacement member 53 during the filling cycle. It is within the scope of the disclosure for the rotation of the ejector arm 44 to be stopped following ejection of the ice cubes 130 from the compartments 66 so that a portion of the ejector member 52 adjacent the rear face 120 of the ejector member 52 is left disposed in the ice forming space of each compartment 66, as shown, for example, in FIG. 15.

After removal of the ejector member 52 from each compartment 66, the level of water in each compartment 66 lowers to below the level of the top surface 98 of the overflow channel 90, as shown, for example, in FIG. 11. Thus each cube 130 is formed separately within its own compartment 66 with no ice bridge or web extending between cubes 130. The size of the ice cube 130 formed in each compartment 66 can be varied by varying the volume of the portion of the ejector member 52 disposed in the ice forming space 104 during the filling operation.

In the illustrated embodiment, once an ice cube 130 has formed in each compartment 66, the controller actuates the heater 54 which heats the tray 20 to expand the same and melt a small amount of ice cube 130 adjacent the walls of each compartment 66. The melting of the cube 130 is believed to provide a lubrication layer between the ice cube 130 and the walls of the compartment 66. Thus, the expansion and lubrication of the tray 20 are believed to reduce the torque which the ejector arm 44 must exert on the ice cube 130 to induce the cube 130 to move along the ejection path of movement and be ejected from the ice tray 20. The design of the walls of the compartments 66 of the ice tray 20 also reduces the torque required for the ejector 22 to eject the ice cubes 130 from the ice tray 20. Additionally, the innovative design of the icemaker assembly 10 that eliminates ice bridges between ice cubes 130 reduces the torque required for ejector 22 to eject the ice cubes. Thus, the temperature rise required in the heating step may be reduced or even eliminated. Additionally, since the torque on the ejector 22 is reduced, a less robust motor 42, drive train 46 and ejector arm 44 may be utilized to eject the ice cubes 130 from the disclosed tray 20.

The innovative design of the icemaker assembly 10 facilitates shorter heating cycles or even the elimination of the heating cycle and facilitates a reduction the power consumption of the heater or the elimination of the heater. Any reduction in the heating cycle also increases the efficiency of the freezer compartment 12 as less heat is required to be dissipated following each ice cube ejection cycle. Additionally, since ice bridges are preferably not formed during freezing and therefore need not be broken during the ejection cycle, the ice cube 130 is less likely to chip than a conventional ice cube during ejection. The reduction or elimination of chips, alone or in combination with the reduction in the heating cycle, makes it less likely that ice cubes 130 will fuse together in the ice bin 24.

Once the ice cubes 130 are ready for ejection, the controller 30 actuates the motor 42 to turn its output shaft which is coupled through the drive train 46 to the ejector shaft 48. The motor 42 drives the ejector shaft 48 to rotate about the rotation axis 91 in the direction of arrow 56 inducing the front face 118 of each ejector member 52 to pass through its associated slot 64 in the ice guiding cover 60 and into contact with the ice cube 130 formed in its associated compartment 66, as shown, for example, in FIG. 12. The front face 118 of each ejector member 52 contacts the top surface 132 of its associated ice cube 130 adjacent the narrow end 140 of the cube 130 and exerts a force driving the narrow end 140 of the cube 130 downwardly along the arcuate bottom surface 82 of the compartment 66.

Figure 13:
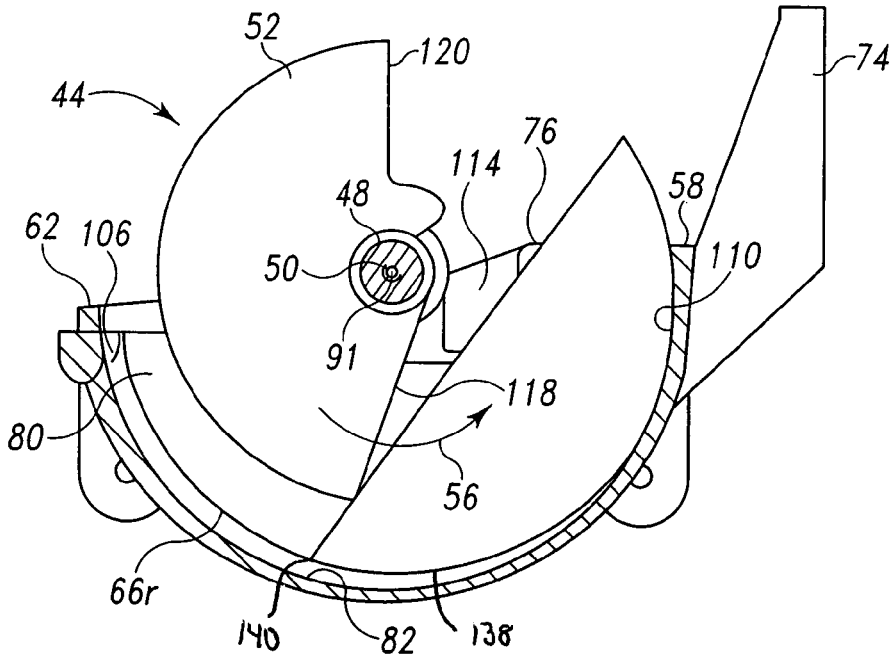
FIG. 13 is a sectional view similar to FIG. 12 after the ejector arm has rotated partially into the ice forming space to urge the ice cube formed in the compartment along an ejection path of motion.

As the narrow end 140 of the ice cube 130 is driven downwardly along the arcuate bottom surface 82 of the compartment 66, the rigidity of the ice cube 130, the bottom wall 138 of the ice cube 130 and the arcuate bottom surface 82 of the compartment 66 cooperate to urge the wide end 144 of the ice cube 130 to move upwardly along the bottom surface 82 of the compartment 66 on the ejection side 58 of the tray 20, as shown, for example, in FIG. 13. As the ejector arm 44 continues to rotate in the direction of arrow 56, the front surface 118 of the ejector member 52 follows the ejection path of movement laterally through the compartment 66 inducing more and more of the ice cube 130 to be ejected from the compartment 66 on the ejection side 58.

As the narrow end 140 of the ice cube 130 approaches the ejection side 58 of the tray 20, the wider end 144 begins to move laterally toward the outside 62 of the tray 20. Eventually, the ice cube 130 falls outwardly and downwardly onto the slide finger 63 of the ice guiding cover 60 which is sloped to induce the ice cubes 130 to slide along the cover 60 and fall off of the outside edge of the cover 60 and into the ice bin 24 located below the ice tray 20.

Once the ejector arm 44 has proceeded along the ejection path of movement a sufficient distance to completely eject the ice cubes 130 from each compartment 66, the ejector member 52 is positioned so that a portion of the ejector member 52 is disposed in the ice forming space 104 in the compartment 66 to displace water during the next fill operation.

Figure 16:
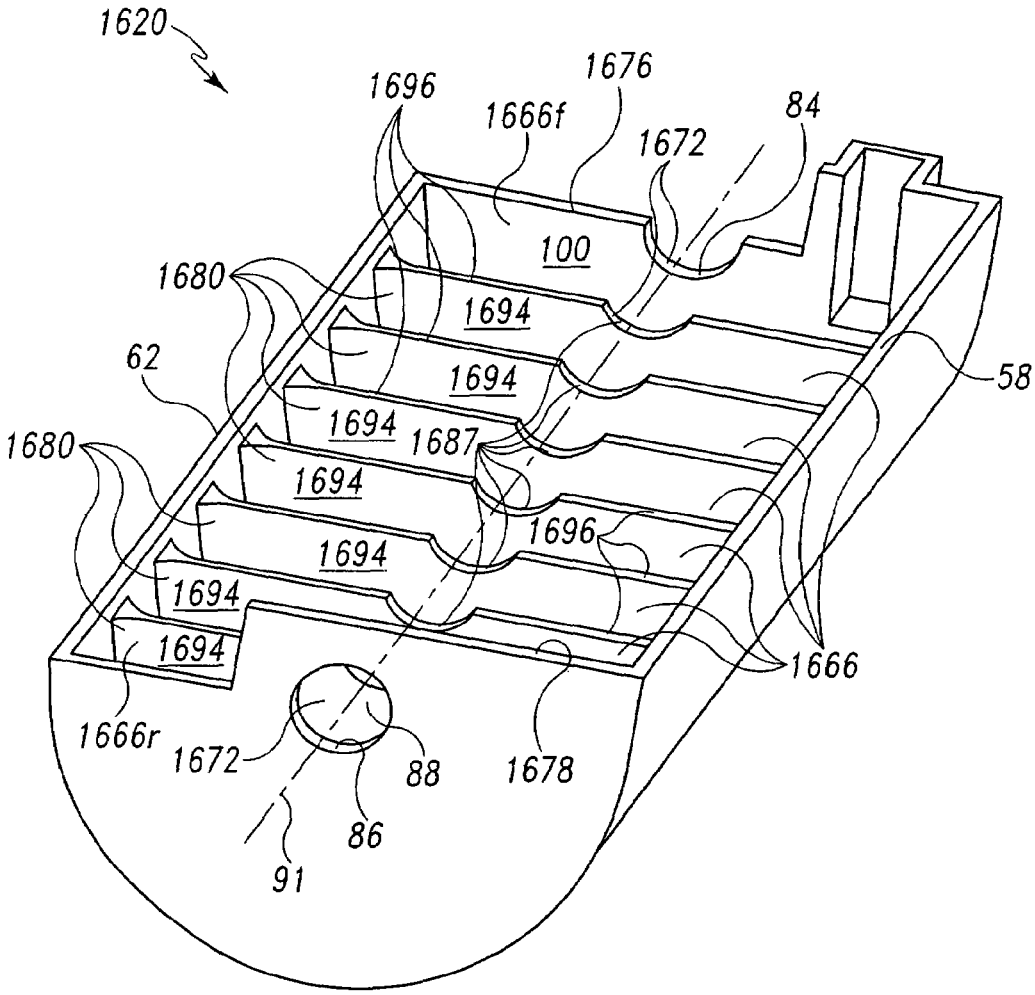
FIG. 16 is a second embodiment of an ice tray for use with the icemaker assembly of FIG. 2 wherein the divider walls between the crescent-shaped compartments do not include weirs or overflow channels.

An alternative embodiment of the ice tray 1620 is shown, for example, in FIG. 16. Ice tray 1620 is substantially similar to ice tray 20 and thus the description of ice tray 20 generally applies to ice tray 1620. Thus, identical reference numerals as those used in describing ice tray 20 will be applied when describing identical features of ice tray 1620. Similar reference numerals, generally 1600 higher than used in describing features of ice tray 20, will be used in describing ice tray 1620.

Ice tray 1620 is formed with divider walls 1680 that are substantially parallel. Thus, ice tray 1620 is similar to prior art ice trays 2020 and to the first embodiment of ice tray 20. However, the divider walls 1680 of ice tray 1620 are not formed to include an overflow channel 90 like the one present in ice tray 20 or a weir 2090 like the one present in ice tray 2020.

As shown, for example, in FIG. 16, ice tray 1620 is formed to include eight tapered crescent-shaped compartments 1666 and ejector arm mounting features 1672. Tray 1620 includes a first end wall 1676, a second end wall 1678, a plurality of partitions or divider walls 1680 and a plurality of floor walls (not shown) that cooperate to form the ice forming compartments 1666. Illustratively, each ice forming compartment 1666 is a crescent-shape similar to the shape of compartments 2066 in prior art ice trays 2020.

The ejector mounting arm features 1672 include a shaft-receiving semi-cylindrical bearing surface 84 formed in the first end wall 76, a shaft-receiving semi-cylindrical bearing surface 86 formed in the second end wall 78, a shaft-receiving aperture 88 formed through the second end wall 78 and shaft-receiving bearing surfaces 1687 formed in each divider wall 80. The shaft-receiving semi-cylindrical bearing surfaces 84, 86, the shaft-receiving aperture 88 and shaft-receiving bearing surfaces 1687 are formed concentrically about the rotation axis 91 of the shaft 48 of the ejector arm 44. The shaft-receiving semi-cylindrical bearing surfaces 84, 86, the shaft-receiving aperture 88 and shaft-receiving bearing surfaces 1687 are sized to receive the shaft 48 of the ejector arm 44 for free rotation therein. The shaft-receiving semi-cylindrical bearing surfaces 84, 86, the shaft-receiving aperture 88 and shaft-receiving bearing surfaces 1687 are positioned to permit the longitudinal axis 50 of the shaft 48 of the ejector arm 44 to coincide with the rotation axis 91 when the ejector arm 44 is received in the tray 20 and rotated by the motor 42 and drive train 46.

As mentioned above, each partition or divider wall 1680 extends laterally, relative to longitudinal axis 50, across the ice tray 1620. In the illustrated embodiment, each divider wall includes a forwardly facing lateral side surface 1692

(not shown from the perspective of FIG. 16), a rearwardly facing lateral side surface 1694 and a top surface 1696. The side surfaces 1692, 1694 and top surface 1696 are formed to position top surface 1696 near the desired maximum fill level of each compartment 1666. The first end wall 76 includes a rearwardly facing lateral side surface 100. The second end wall 78 includes a forwardly facing lateral side surface 102 (not shown from the perspective of FIG. 16).

In the illustrated embodiment, water from the water inlet 28 flows down the end water inlet ramp 68 into the rear ice forming compartment 1666*r*. The water enters and fills the rear ice forming compartment 1666*r* until the level reaches the level of the top wall 1696 of the divider wall 1680 and then overflows into the compartment 1666 adjacent the rear compartment 1666*r*. After water fills each compartment 1666 it overflows the divider wall 1680 over the top surface 1696 and into the adjacent compartment 1666. When the water in all of the compartments 1666 has reached a desired level, determined as described above, water flow stops.

The overflow method can also be used to fill all of the compartments 1666 of the ice tray 1620 when water first flows into the center compartment 1666*c* in the manner described above with regard to ice tray 20.

Using the overflow method of filling the ice tray 1620 might result in an ice bridge or web forming between the ice cubes above the top surface 1696 of each divider wall 1680 if water is not displaced from each compartment during the filling process. However, the ejector 22 works in cooperation with the ice tray 1620 in the same manner as with ice tray 20. Therefore, portions of the ejector members 52 are disposed in the ice forming spaces 1704 to act as displacement members 53 during the filling process. Thus, when the displacement members 53 are removed from the ice forming compartments 1666 following the filling process, the water level in each compartment 1666 drops below the level of the top surface 1696.

The compartments 1666 in ice tray 1620 are configured to include a space 1704 in which a crescent-shaped ice cube similar to prior art ice cubes except without the ice bridge is formed. In the illustrated embodiment first end wall 76 includes a planar lateral side surface 100 and second end wall 78 includes a planar lateral side surface 102. Each partition member or divider wall 1680 includes a top surface 1696 and two downwardly extending oppositely facing lateral side surfaces 1692, 1694. The ice forming space 1704 in each compartment 1666 includes a first planar lateral side surface 100 or 1694, a second planar lateral side surface 102 or 1692, and an arcuate bottom surface interposed between the first lateral side surface 100 or 1694 and the second lateral side surface 102 or 1692.

Each compartment 1666 is substantially identical. In each compartment 1666, one planar lateral side surface 100, 94, from an end wall 76 or a divider wall 80, respectively, is positioned relative to a second planar lateral side surface 92, 102, from an adjacent divider wall 80 or end wall 78, respectively, so that the first planar lateral side surface 100, 94 is spaced apart from the second planar lateral side surface 92, 102 by a substantially constant distance relative to the ejection path of movement.

In the illustrated embodiment, each lateral side surface 1692, 1694, 100, 102 is planar, except for a bottom portion that smoothly curves into the bottom surface to facilitate formation of the ice tray 20 using a molding process. As in prior art ice trays, the width of the compartment 1666 may be narrower near the bottom and wider near the top to facilitate formation of the ice tray 20 using a molding process.

Figure 17:
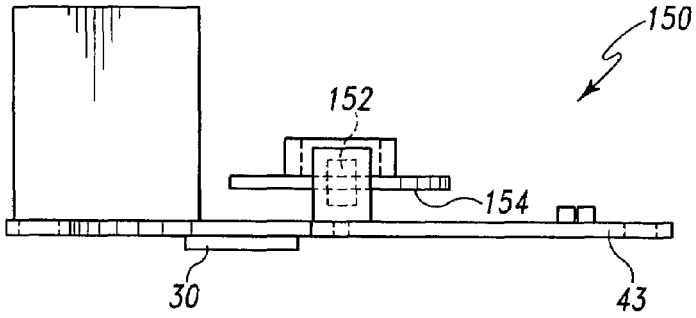
FIG. 17 is an elevation view of portions of the PCB with components removed for clarity showing a transformer, a rotary detection emitter and sensor and a ejector arm encoder face cam of the drive train for detecting the position of the ejector arm.
Figure 18:
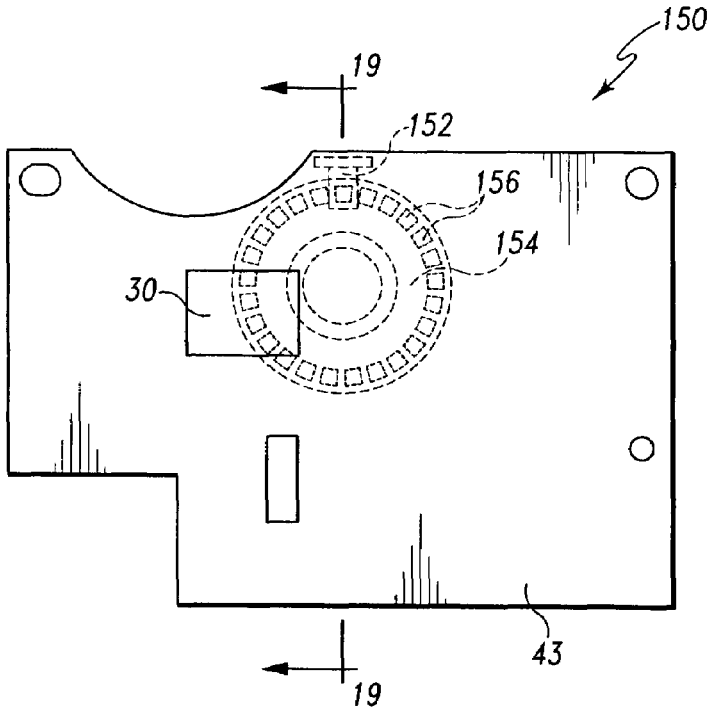
FIG. 18 is an elevation view of the PCB of FIG. 17 with the a rotary detection emitter and sensor and a ejector arm encoder face cam and indicia thereon shown in phantom lines.
Figure 19:
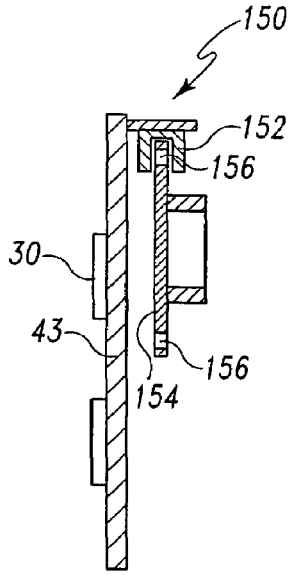
FIG. 19 is a sectional view taken along line 19—19 of the PCB, a rotary detection emitter and sensor, ejector arm encoder face cam and indicia of FIG. 18.

As shown, for example, in FIGS. 17–19, the icemaker assembly 10 includes an ejector arm position sensor 150 coupled to the controller 30. Illustratively, the position sensor 150 is implemented using a rotary detection emitter and sensor 152 and an ejector arm encoder face cam 154 of the drive train 46. Illustratively, rotary detection emitter and sensor 152 may be an Optek PHOTOLOGIC® slotted optical switch, such as Part Number OPB961N51 available from Optek Technology, Inc., 1215 W. Crosby Road Carrollton, Tex. 75006.

The ejector arm encoder face cam 154 is one component of drive train 46 coupling motor 42 to the ejector arm 44. By sensing the position of the ejector arm encoder face cam 154, the position of the ejector members 52 is established. The ejector arm encoder face cam 154 includes indicia 156 responsive to the rotary detection emitter and sensor 152 for indicating the angular position of the ejector arm 44. In the illustrated embodiment, indicia 156 includes a plurality of holes formed in the ejector arm encoder face cam 154 for permitting signals transmitted by the rotary detection emitter to propagate to the rotary position sensor.

As shown for example, in FIG. 19, the ejector arm encoder face cam 154 and rotary detection emitter and sensor 152 are mounted so that the ejector arm encoder face cam 154 rotates within the slot between the sensor and emitter in the rotary detection emitter and sensor 152. The solid portions of the ejector encoder face cam 154 interfere with the signal emitted by the rotary detection emitter when they are disposed between the emitter and sensor. Those skilled in the art will recognize that other indicia and rotary detection emitter and sensors, including indicia comprising reflective surfaces that reflect emitted signals onto a signal sensor are within the scope of the disclosure. It is within the scope of the disclosure for such reflective indicia to be coded so that the exact position of the ejector arm 44 can be determined during rotation.

Preferably indicia 156 are present to selectively interfere, or not interfere, with the detection signal when the ejector arm 44 is positioned as shown in each of FIGS. 10–15. Alternative methods and components may be used to detect the position of the ejector arm 44 within the scope of the disclosure including Hall sensor, tracking the energized winding of a stepper motor when such is used as the motor 42, strobes and optical sensors and the like.

Figure 21:
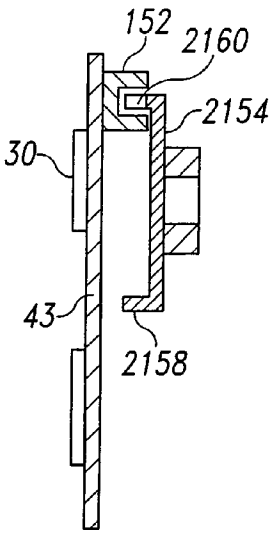
FIG. 21 is a sectional view similar to that shown in FIG. 19 showing the alternative drum-type ejector arm encoder face cam of FIG. 20, a PCB and a rotary detection emitter and sensor positioned to sense the indicia.
Figure 20:
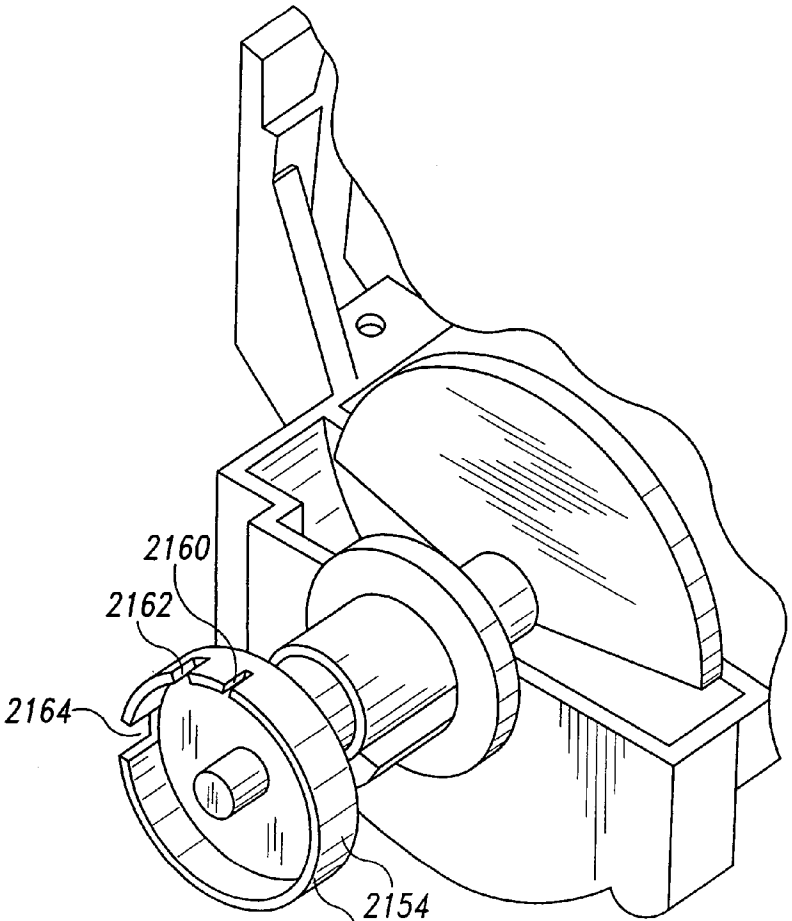
FIG. 20 is a perspective view of a portion of an ice tray, ejector arm and an alternative drum-type ejector arm encoder face cam having indicia formed as slots in a cylindrical axially extending wall.

As shown, for example, in FIGS. 20–21, a PCB 43 may include a rotation detector emitter and sensor 152 mounted in an orientation permitting a cylindrical axially extending wall 2158 of an alternative drum-type ejector arm encoder face cam 2154 to pass between its emitter and detector. Slots 2160, 2162 and 2164 are formed in the cylindrical axially extending wall 2158 to act as indicia 156. In the illustrated embodiment, indicia 156 include a home position slot 2160, a stall position slot 2162 and a heater disengagement slot 2164. Illustratively, rotation detection emitter and sensor 152 is mounted so that the home slot 2160 is positioned between the emitter and sensor when the ejector arm 44 is positioned to dispose the entire ejector member 52 outside of the ice forming cavities 66, i.e. in a position such as that shown in FIGS. 11, 20–21. Those skilled in the art will recognize that a single home position slot 2160 would be sufficient to provide a calibration point for controlling the position of the ejector members 52 based on tracking the windings that are energized in a stepper motor or elapsed time and angular velocity or other open loop control algorithms for other electric motors.

Figure 12:
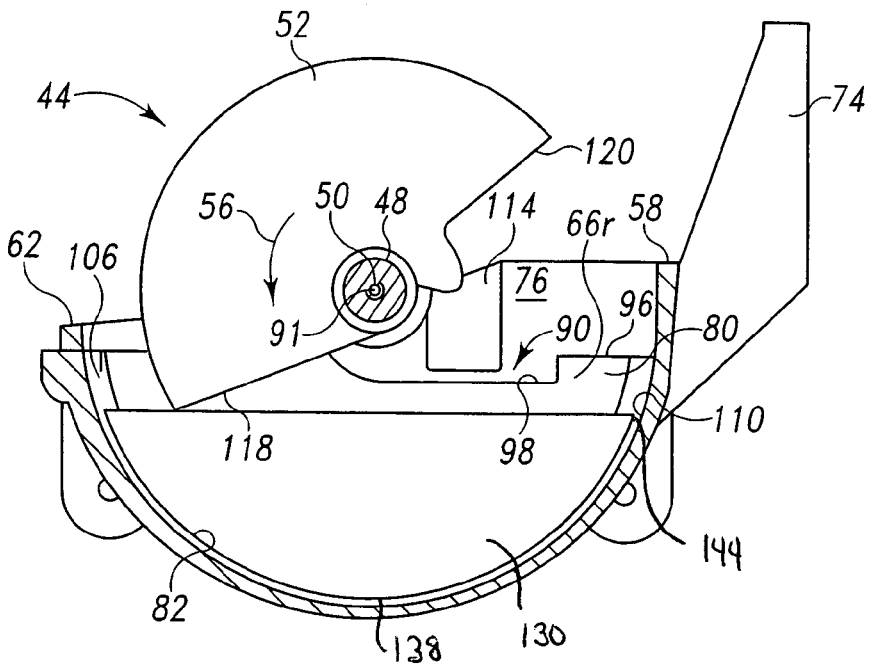
FIG. 12 is a sectional view similar to FIG. 11 after ice has formed in the compartment and the ejector arm has been rotated to bring the front face of the ejector member into contact with the top surface of the ice cube formed in the compartment.

As shown, for example, in FIG. 20, the stall slot 2162 is located on the cylindrical axially extending wall 2158 of the ejector arm encoder face cam 2154 so that the slot 2162 is disposed between the emitter and sensor of the rotation detection emitter and sensor 152 when the ejector members 52 are in a position where they are likely to engage ice formed in the ice forming compartments 66, i.e. in a position such as that shown in FIG. 12. Thus, sensor sends a stall condition signal to controller 30 during the period that it is able to detect the signal emitted by the emitter as a result of the stall slot 2162 being disposed between the sensor and emitter of the rotation detection emitter and sensor 152. During an ejection cycle, the stall condition signal indicates that the conditions are ripe for a motor stall. When the ejector members 52 first engage the ice formed in the ice forming compartment, the motor 42 and ejector arm 44 often stall. Thus, when the controller 30 receives a stall condition signal during an ejection cycle, the controller 30 is programmed to appropriately respond to a motor stall.

In the illustrated embodiment, during a filling cycle, the termination of the stall condition signal while the ejector arm is rotating in the direction of arrow 56 indicates to the controller 30 that the ejector members 52 have likely entered the space 104 in the ice forming compartments 66. By keeping track of winding energization when the stepper motor 42 is utilized or through utilization of other open loop position control algorithms when a unidirectional motor is utilized, the controller 30 can appropriately position the ejector members 52 to act as displacement members 53 to displace the appropriate amount of water to make discrete ice cubes 130 of various sizes. Alternatively, additional indicia 156 such as slots formed in axially extending wall 2158 could be provided to indicate when displacement members 53 are in various positions using feedback position control algorithms.

The heater slot 2164 is positioned on the cylindrical axially extending wall 2158 of the ejector arm encoder face cam 2154 relative to the emitter sensor to provide an indication that the ejector members 52 have rotated sufficiently into the ice forming compartments 66 to allow the heater to be turned off during an ejection cycle. During a filling cycle, the controller 30 may utilize the signal generated by the sensor when the heater slot 2164 is disposed between the emitter and sensor to control the position of the ejector members 52 within the ice forming compartments 66.

The illustrated icemaker assembly 10 includes a controller 30 that is implemented at least in part by a microcontroller and memory. While many microcontrollers, microprocessors, integrated circuits, discrete components and memory devices may be utilized to implement controller 30, the illustrated controller utilizes a 72F324-J685 microcontroller from ST Microelectronics and EEPROM memory available as part number ULN2803A from Toshiba America Electronic Components Inc. The disclosed microcontroller receives signals from various sensors and components, such as the ejector arm position sensor 150, the fill level sensor, the ice tray temperature sensor 160, to control various components, such as motor 42, heater 54, and the solenoid operated valve in the water inlet, so that the icemaker assembly operates in the manner described. The microcontroller also reads data from and writes data to the memory. The memory may store energized winding data, motor direction data, ejector arm position data and other information useful to the operation of ice maker assembly.

Figure 22:
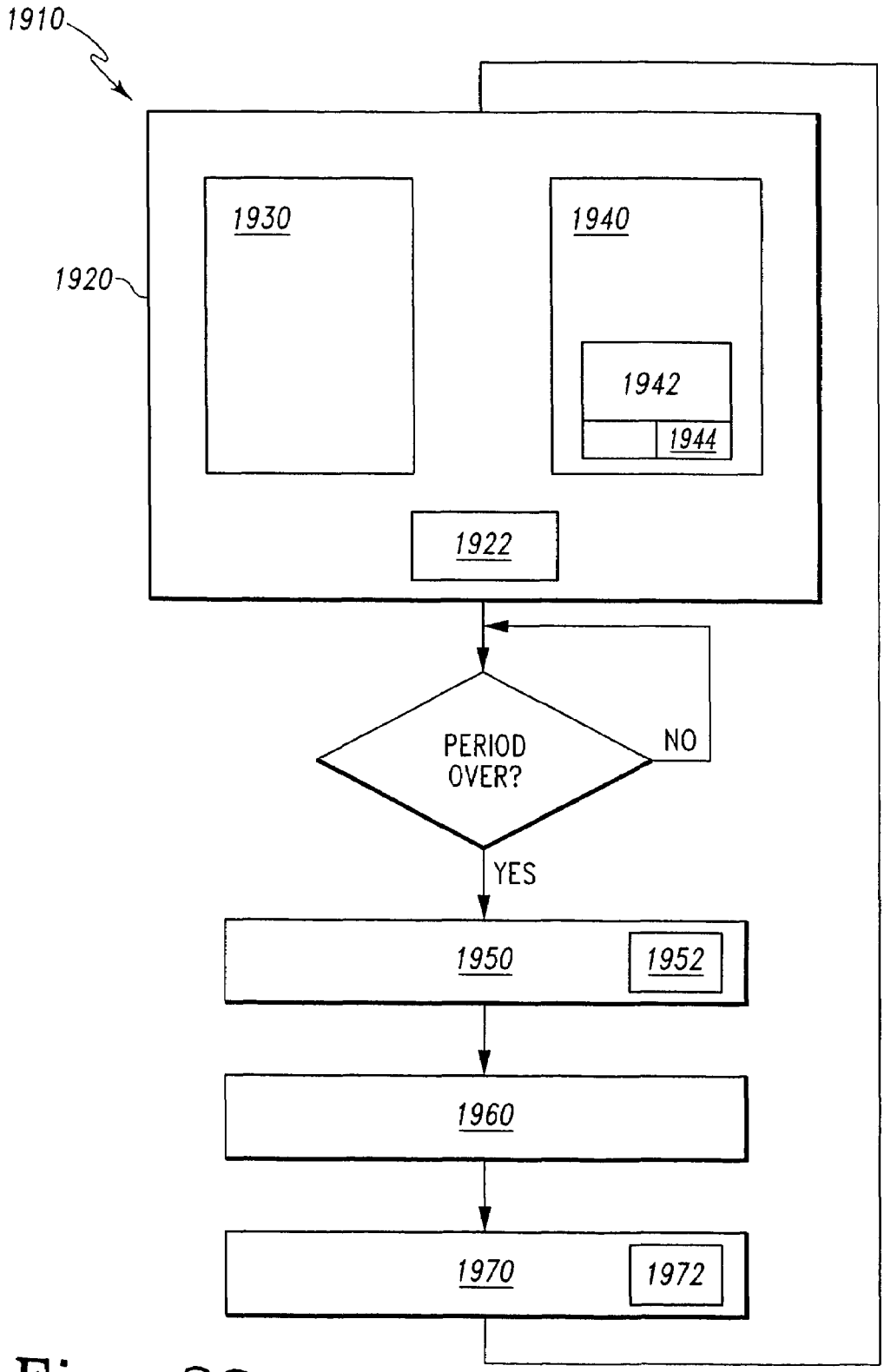
FIG. 22 is a flow diagram of a method of eliminating connecting webs between ice cubes.

As shown for example, in FIG. 22, a method of making ice 1910 comprises the step of filling an ice tray with a quantity of water 1920. The ice may include a plurality of ice forming compartments having at least (i) a first ice forming compartment defining a first space, (ii) a second ice forming compartment defining a second space, and (iii) a partition member interposed between the first space and the second space. When more than the first and second ice forming compartments are present, the ice tray includes a number of spaced apart plurality of partition members defining the plurality of compartments. Each partition member may have defined therein a fluid passage. Exemplary ice trays for use with the method of filling an ice tray 1920 include the ice trays 20, 1620, 2620 and 2720 disclosed above.

The filling an ice tray step 1920 may include the steps of advancing water into an ice tray of an icemaker assembly 1930 and positioning displacement members within a plurality of ice forming compartments of the ice tray 1940. The advancing water into an ice tray of an icemaker assembly step 1930 and the positioning displacement members within a plurality of ice forming compartments of the ice tray step 1940 is performed so that for a period of time both the water and the displacement members are simultaneously located within the plurality of ice forming compartments. Illustratively, the water may be advanced into the ice tray before the displacement members are positioned within the plurality of ice forming compartments, the water may be advanced into the ice tray after the displacement members are positioned within the plurality of ice forming compartments, or the displacement members may be positioned within the plurality of ice forming compartments while the water is being advanced into the ice tray such steps being performed concurrently, all within the scope of the disclosure. Alternatively, the displacement members may be positioned within the plurality of ice forming compartments after the water has been advanced into the ice tray.

The advancing the water step 1930 may include advancing a quantity of water within the ice tray. The quantity of water may be advanced into the ice tray so that the quantity of water is unevenly distributed among a plurality of ice forming compartments of the ice tray in the advancing step 1930. The advancing step may include advancing water through each fluid passage in response to the step of positioning displacement members within the plurality of ice forming compartments of the ice tray.

The step of positioning displacement members within a plurality of ice forming compartments of the ice tray 1940 may include a rotating a shaft having the displacement member secured thereto about an axis of rotation step 1942. When the water is advanced so that the quantity of water is unevenly distributed, the positioning the displacement members step should cause a part of the quantity of water to advance from a first number of a plurality of ice forming compartments to a second number of a plurality of ice forming compartments. The positioning step 1940 may include positioning a first displacement member in the first space and a second displacement member in the second space. When a first displacement member and second displacement member are present, the positioning step 1940 may include the step 1944 of rotating a shaft having the first displacement member and the second displacement member each secured thereto about an axis of rotation.

During the filling step 1920, the water level of the quantity of water located within the ice tray is vertically above at least a part of a top edge of the partition when (i) the first displacement member is positioned in the first space, and (ii) the second displacement member is positioned in the second space. The water level of the quantity of water located in said ice tray is vertically below the entire top edge of the partition when (i) the first displacement member is spaced apart from the first space, and (ii) the second displacement member is spaced apart from the second space. When the partition members are formed to include a fluid passage located at said top edge of the partition, the method of filling a tray 1920 further includes the step 1922 of advancing water through the fluid passage in response to the positioning step.

The method of making ice 1910 may also comprise the steps of moving the displacement members out of the plurality of ice forming compartments 1950, reducing the temperature of the water within the ice tray 1960 and moving the displacement members 1970. The moving the displacement members out of the plurality of ice forming compartments step 1950 is performed after the period of time. The moving the displacement members out of the plurality of ice forming compartments after the period of time step may include the step 1952 of further rotating the shaft about the axis of rotation.

The reducing the temperature of the water within the ice tray step 1960 is performed so as to cause the water located within the plurality of ice forming compartments to become a plurality of discrete ice cubes while the displacement members are located out of the plurality of ice forming compartments.

The moving the displacement members step 1970 moves the displacement members into contact with the plurality of discrete ice cubes so that the plurality of ice cubes are urged out of the plurality of ice forming compartments. The step 1970 of moving the displacement members into contact with the plurality of discrete ice cubes includes the step 1972 of additionally rotating the shaft about the axis of rotation.

The icemaker assembly 10 disclosed herein seeks to eliminate the ice bridge formed between adjacent cubes, however, the complete elimination of the ice bridge can lead to ice cubes 130 obtaining orientations during ejection that could inhibit the cubes falling out of the ice maker tray 20 onto the slide fingers 63 of the cover 60 and sliding into the bin 24. The ice bridge in prior art cubes acts as a stabilizer or guide permitting the ice cubes to interact with adjacent ice cubes during ejection to facilitate proper alignment of the ice cubes and complete ejection of the same from the ice tray onto the cover and into the ice bin. Occasionally the ice bridge between prior art ice cubes breaks during ejection allowing the ice cubes to become misaligned and not be properly ejected from the tray. These incompletely ejected ice cubes can interfere with rotation of the ejector member and cause a jam.

Those skilled in the art will recognize that the elimination of the ice bridge by the disclosed ice maker assembly 10 may result in ice cube misalignment during ejection and possible incomplete ejection of the ice cubes 130. Thus, an ejection guide 170 may be provided to facilitate proper alignment of ice cubes 130 during ejection and complete ejection of ice cubes 130 from the tray 20. Such an ejection guide 170 may take several different forms, as shown, for example, in FIGS. 24–28.

Figure 24:
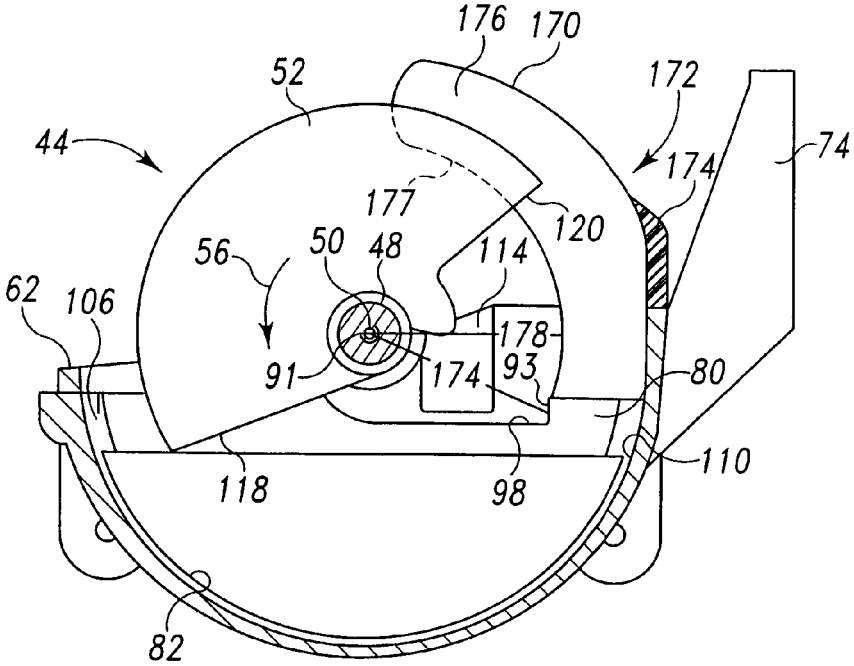
FIG. 24 is a sectional view of an ice tray with an additional cover attached to the ejection side of the tray which includes guide fingers for guiding the ice cube during the ejection process.
Figure 25:
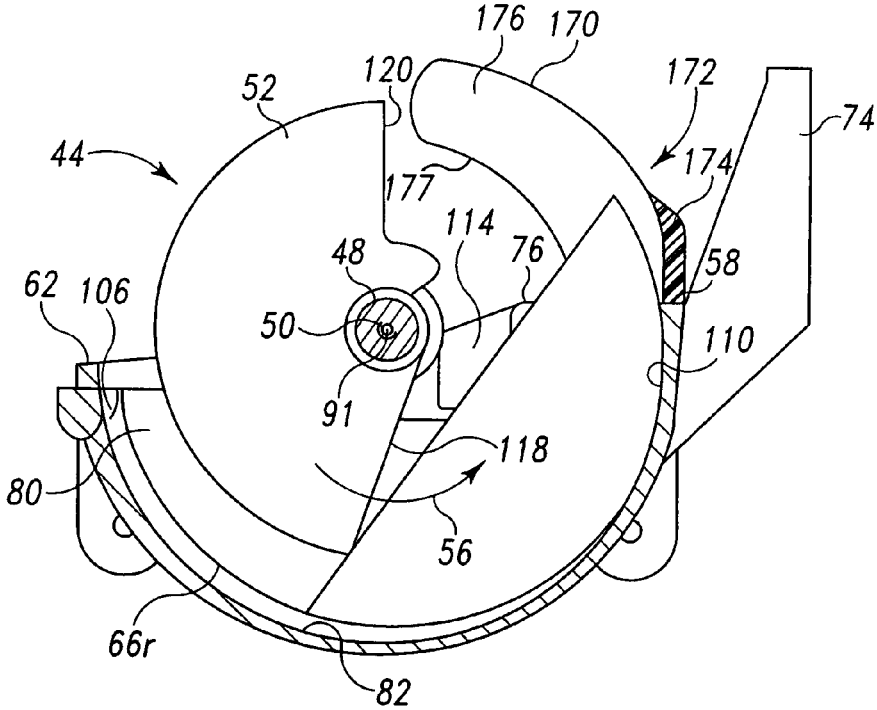
FIG. 25 is a sectional view similar to FIG. 24 showing an ice cube being guided by the guide finger of the additional cover during the ejection process.

FIGS. 24 and 25 show sectional views of the ice tray 20 and a separate cover 172 configured to act as an ejection guide 170 for mounting to the ejection side 58 of the tray 20. The separate cover 172 includes a longitudinal spine portion 174 (shown in cross section) extending along the length of the ejection side 58 of the tray 20. A plurality of guide fingers 176 extend from the spine portion 174 over the tray 20. A guide finger 176 is provided for extending over each divider wall 80 and end wall 100, 102 of the tray 20 so that ice cubes 130 ejected from the tray 20 are guided between adjacent guide fingers 176 during ejection. Preferably, the underside 177 of each guide finger 176 is configured so as to not interfere with any incidental ice bridge that may be formed between cubes 130 as a result of a faulty overfill situation or a non-level mounting of the tray 20. In the illustrated embodiment of the separate cover 172, the underside 177 of each guide finger 176 has a radius of curvature 178 centered about the rotation axis 91 of the ejector arm 44. The radius of curvature 178 is greater than the displacement of 179 the ejection side end 93 of the overflow channel 90 from the rotation axis 91. Thus, any incidental ice bridge formed in overflow channel 90 will not come in contact with the guide finger 176 during ejection. While not visible in cross section, the guide fingers 176 have a width equal to, or less than, the thickness of the divider wall 80 adjacent the ejection side 58 of the tray 20.

Those skilled in the art will recognize that guide fingers 176 and spine portion 174 may take on other shapes within the scope of the disclosure. For example, guide fingers 176 may extend farther away form the spine portion 174 toward the outside edge 62 of the tray 20 than illustrated in FIGS. 24 and 25. Alternatively, guide fingers 176 or may not extend as far away from the spine portion 174 toward the outside edge 62 of the tray 20 as illustrated in FIGS. 24 and 25. Also, guide fingers may be taller or shorter than illustrated in FIGS. 24 and 25. It is also within the scope of the disclosure for a separate cover 172 to be utilized with ice tray 1620.

Figure 26:
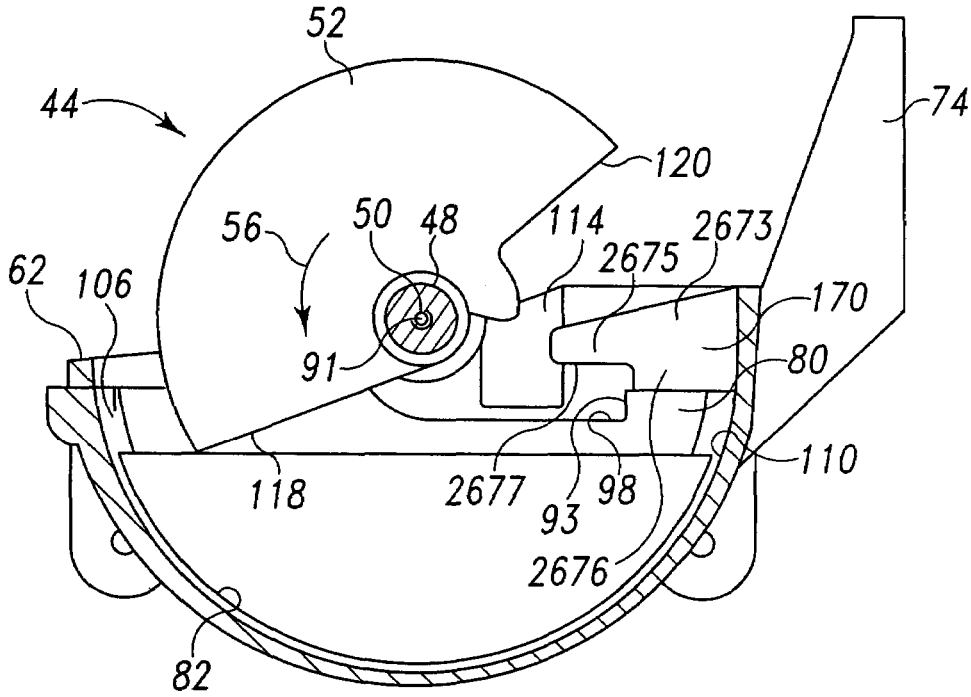
FIG. 26 is a sectional view of an additional embodiment of an ice tray for use with the disclosed ice maker assembly including guide fingers coupled to the ejection side portion of the divider walls for guiding the ice cube during the ejection process.

FIG. 26 illustrates an ejection guide 170 implemented as a guide finger 2676 formed as a component of a tray 2620. While only a single guide finger 2676 is shown, it should be recognized that a guide finger 2676 should be provided for each divider wall 80 and end wall of the tray 2620. Except for the addition of the guide fingers 2676, tray 2620 is identical to tray 20 and, thus identical reference numerals are utilized to describe identical components. In fact it is within the scope of the disclosure for guide fingers 2676 to be formed as separate components that are mounted to the tray 20 to form tray 2620. Alternatively, the guide fingers 2676 may be integrally formed as a portion of tray 2620. If tray 2620 is molded, a more complex molding process may need to be utilized or an additional operations may need to be performed to generate the underside 2677 of the cantilevered portion 2675 of each guide finger 2676 and the ejection side end 93 of the overflow channel 90 underlying the cantilevered portion 2675 of each guide finger 2676.

Guide finger 2676 is mounted to the ejection side 58 of the tray 2620 and extends upwardly and outwardly (i.e. toward the outer side 62 of the tray 2620). Preferably a separate guide finger 2676 is provided for each divider wall 80 and end wall 76, 78 of the tray 2620. Each guide finger 2676 includes a body portion 2673 for mounting to the top wall 96 of each divider wall 80 and/or end wall 76, 78 and a cantilevered finger portion 2675 that extends from the body portion 2673 toward the outside 62 of the tray 2620 over the ejector end 93 of the overflow channel 90.

Figure 27:
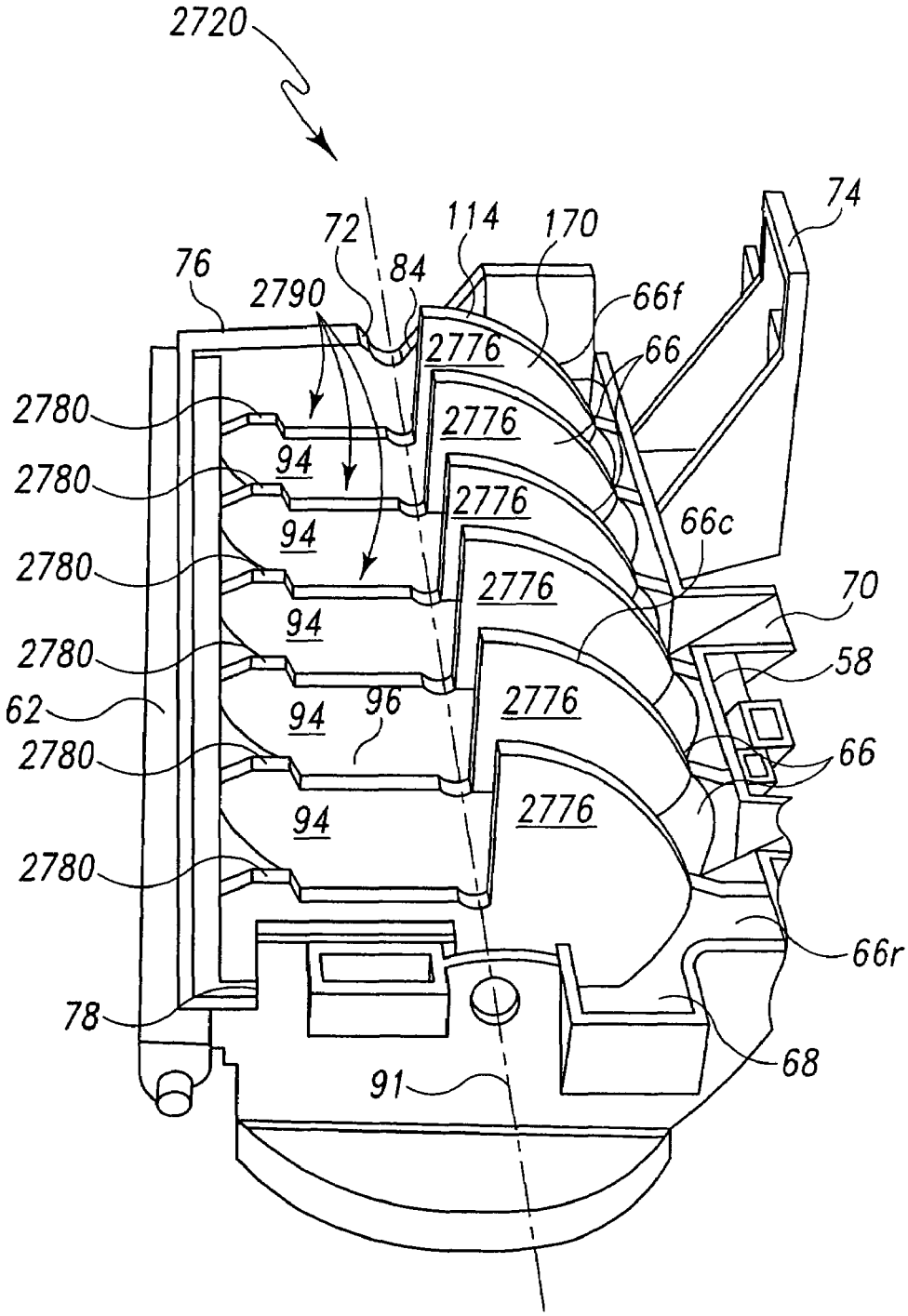
FIG. 27 is a perspective view of an alternative ice tray for use with the disclosed icemaker assembly showing an overflow channel formed in outer portion of each of the divider walls and guides extending upwardly from top surface of the divider walls and end walls on the ejection side of the tray for guiding the ice cube during the ejection process.

FIG. 27 illustrates an alternative moldable monolithic tray including guide fingers 2776 acting as an ejection guide 170. Tray 2720 is very similar to tray 20. The overflow channel 2790 formed in each divider wall 2780 is moved from the ejection side portion of divider wall (i.e. that portion of divider wall that is closer to the ejection side 58 of the tray 20) to the outside portion of the divider wall 2780 (i.e. that portion of divider wall 2780 that is closer to the outside 62 of the tray 2720). Also, guide fingers 2776 are formed extending upwardly from the top wall 2796 of the divider wall 2780 and each of the end walls 76, 78 on the ejection side of the tray 2720.

During ejection, each ice cube 130 is guided between adjacent guide fingers 2776 until it falls onto the cover 60 (not shown) disposed over the outside of tray 2720. When tray 2720 is utilized in an ice maker assembly 10, the motor 42 and ejector arm 44 and or the heater 54 should be robust enough to annihilate any incidental ice bridge that might be formed as the result of an accidental overfill or unlevel mounting of the tray 2720.

Figure 28:
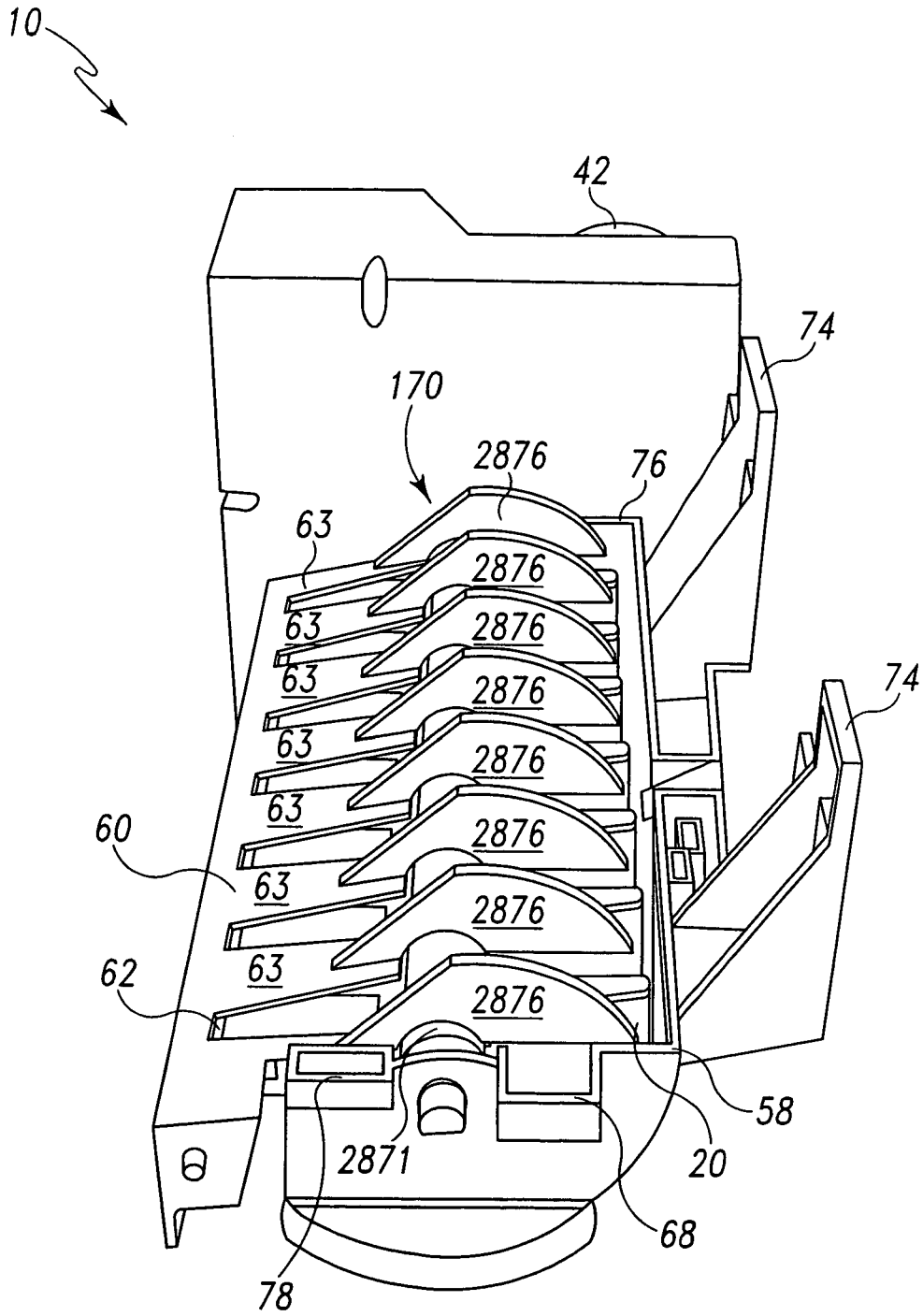
FIG. 28 is a perspective view of an ice maker assembly including an alternative embodiment of a cover having guide fingers extending over the ejector member to be positioned above the ejection side portion of the divider walls between the compartments for guiding the ice cubes formed therein during the ejection process.

FIG. 28 shows an alternative guide mechanism 170 formed by modifying the cover 60 that guides the ice 130 to fall off of the outer edge of the assembly 10 into the ice bin 24. The modified cover 2860 includes guide fingers 2876 formed on the upper surface of the slide fingers 63 of the cover 2860. Guide fingers 2876 are formed extending upwardly and toward the ejection side 58 of the tray 20 from the top surface of the fingers 63 defining the slots 64 through which the ejector members 52 pass. Since the fingers 63 of the cover 60 are configured to lie over the divider walls 80 of the tray 20, the guide fingers 2876 are centered on each finger 63 so that they are disposed over the divider walls 80 of the tray 20. The guide fingers 2876 are configured to include a curved bottom surface 2871 to avoid interfering with rotation of the shaft 48 of the ejector arm 44. The bottom of the ejection side of the guide fingers 2876 can extend downwardly to rest on the top surface 96 of the divider walls 80 and end walls 100, 102 of the tray 20. Ice cubes 130 ejected from tray 20 are guided by the guide fingers 2876 during ejection and are urged to fall onto the fingers 63 in a proper orientation to slide off of the cover 60 into the ice bin 24.

While the icemaker assembly 10 is disclosed with reference to the illustrated refrigerator/freezer 14 having a through-the-door ice dispenser, it is within the scope of the disclosure for the invention to be utilized in an icemaker assembly 10 without an automatic ice dispenser. Such icemakers typically include a bin 24 having a top opening large enough to receive ice cubes 130 ejected from the icemaker tray 20 and also allowing access to ice cubes 130 in the bin 24 by the dwelling occupant.

Although specific embodiments of the invention have been described herein, other embodiments may be perceived by those skilled in the art without departing from the scope of the invention as defined by the following claims.

What is claimed is:

1. A method of making ice, comprising:

advancing water into an ice tray of an icemaker assembly and positioning displacement members within a plurality of ice forming compartments of said ice tray while said water advances into the plurality of ice forming compartments so that for a period of time both said water filling said plurality of ice forming compartments and said displacement members are simultaneously located within said plurality of ice forming compartments so a portion of said water advancing into said plurality of ice forming compartments is displaced;

moving said displacement members out of said plurality of ice forming compartments after said period of time so that said water in said plurality of ice forming compartments drops to a level lower than a level at which the water was when the displacement members were located in said plurality of ice forming compartments as water advanced into the compartments;

reducing the temperature of said water within said ice tray so as to cause said water at said lower level located within said plurality of ice forming compartments to become a plurality of discrete ice cubes while said displacement members are located out of said plurality of ice forming compartments; and moving said displacement members into contact with said plurality of discrete ice cubes so that said plurality of ice cubes are urged out of said plurality of ice forming compartments.

2. The method of claim 1, wherein said advancement of said water into said ice tray commences before said displacement members are positioned within said plurality of ice forming compartments as said water advances into said ice forming compartments.

3. The method of claim 1, wherein said advancement of said water into said ice tray commences after said displacement members are positioned within said plurality of ice forming compartments so said water advances into said ice forming compartments into which said displacement members have been positioned.

4. The method of claim 1, wherein said displacement members are positioned to a stopped position within said plurality of ice forming compartments while said water is being advanced into said ice tray.

5. The method of claim 1, wherein said step of positioning displacement members within a plurality of ice forming compartments of said ice tray includes the step of rotating a shaft having said displacement members secured thereto about an axis of rotation until said displacement members are within said plurality of ice forming compartments during the period of time in which water is advancing into the plurality of compartments.

6. The method of claim 5, wherein said step of moving said displacement members out of said plurality of ice forming compartments after said period of time includes the step of further rotating said shaft about said axis of rotation in order to lower the level of water in the ice forming compartments after said water stops advancing.

7. The method of claim 6, wherein said step of moving said displacement members into contact with said plurality of discrete ice cubes includes the step of additionally rotating said shaft about said axis of rotation.

8. The method of claim 1, wherein:

said ice tray includes a number of spaced apart partition members that define said plurality of ice forming compartments, each of said partition members has defined therein a fluid passage, and water is advanced through each said fluid passage while said displacement members are positioned within said plurality of ice forming compartments of said ice tray.

9. A method of making ice, comprising the steps of:

advancing a quantity of water to an ice tray so that said quantity of water is unevenly distributed among a plurality of ice forming compartments of said ice tray;

positioning displacement members within said plurality of ice forming compartments so that a part of said quantity of water is caused to advance from a first number of said plurality of ice forming compartments to a second number of said plurality of ice forming compartments;

moving said displacement members out of said plurality of ice forming compartments after a period of time;

reducing the temperature of said water within said ice tray so as to cause said water located within said plurality of ice forming compartments to become a plurality of discrete ice cubes while said displacement members are located out of said plurality of ice forming compartments; and moving said displacement members into contact with said plurality of discrete ice cubes so that said plurality of ice cubes are urged out of said plurality of ice forming compartments.

10. The method of claim 9, wherein said step of positioning displacement members within a plurality of ice forming compartments of said ice tray includes the step of rotating a shaft having said displacement member secured thereto about an axis of rotation.

11. The method of claim 10, wherein said step of moving said displacement members out of said plurality of ice forming compartments after said period of time includes the step of further rotating said shaft about said axis of rotation.

12. The method of claim 11, wherein said step of moving said displacement members into contact with said plurality of discrete ice cubes includes the step of additionally rotating said shaft about said axis of rotation.

13. The method of claim 9, wherein:

said ice tray includes a number of spaced apart partition members that define said plurality of ice forming compartments, each of said partition members has defined therein a fluid passage, and water is advanced through each said fluid passage in response to said positioning step.

14. A method of filling an ice tray with a quantity of water, comprising the steps of:

advancing a quantity of water to an ice tray so that said quantity of water is unevenly distributed among a plurality of ice forming compartments of said ice tray; and positioning displacement members within said plurality of ice forming compartments so that a part of said quantity of water is caused to advance from a first number of said plurality of ice forming compartments to a second number of said plurality of ice forming compartments.

15. The method of claim 14, further comprising the step of moving said displacement members out of said plurality of ice forming compartments after said positioning step.

16. The method of claim 15, wherein said positioning step includes the step of rotating a shaft having said displacement member secured thereto about an axis of rotation.

17. The method of claim 16, wherein said moving step includes the step of further rotating said shaft about said axis of rotation.

18. The method of claim 14, wherein:

said ice tray includes a number of spaced apart partition members that define said plurality of ice forming compartments, each of said partition members has defined therein a fluid passage, and water is advanced through each said fluid passage in response to said positioning step.

19. A method of filling an ice tray with a quantity of water, said ice tray having at least (i) a first ice forming compartment defining a first space, (ii) a second ice forming compartment defining a second space, and (iii) a partition member interposed between said first space and said second space, comprising the steps of:

positioning a first displacement member in said first space, and a second displacement member in said second space; and advancing said quantity of water within said ice tray, wherein a water level of said quantity of water located within said ice tray is vertically above at least a part of a top edge of said partition when (i) said first displacement member is positioned in said first space, and (ii) said second displacement member is positioned in said second space, and wherein said water level of said quantity of water located in said ice tray is vertically below the entire top edge of said partition when (i) said first displacement member is spaced apart from said first space, and (ii) said second displacement member is spaced apart from said second space.

20. The method of claim 19, wherein said positioning step is performed before said advancing step.

21. The method of claim 19, wherein said positioning step is performed after said advancing step.

22. The method of claim 19, wherein said positioning step and said advancing step are performed concurrently.

23. The method of claim 19, wherein said partition member has defined therein a fluid passage located at said top edge of said partition, further comprising the step of:

advancing water through said fluid passage in response to said positioning step.

24. The method of claim 19, wherein said positioning step includes the step of rotating a shaft having said first displacement member and said second displacement member each secured thereto about an axis of rotation.

25. An icemaker assembly, comprising:

an ice tray having at least (i) a first ice forming compartment defining a first space, and (ii) a second ice forming compartment defining a second space; and an ice ejector positionable at a first position and a second position, said ice ejector having at least (i) a first ejector member, and (ii) a second ejector member, wherein, when said ice ejector is positioned at said first position, (i) said first ejector member is positioned in said first space and in contact with a first quantity of water, (ii) said second ejector member is positioned in said second space and in contact with a second quantity of water, and (iii) said first quantity of water is positioned in fluid communication with said second quantity of water, and wherein, when said ice ejector is positioned at said second position, (i) said first ejector member is spaced apart from both said first space and said first quantity of water, (ii) said second ejector member is spaced apart from both said second space and said second quantity of water, and (iii) said first quantity of water is isolated from fluid communication with said second quantity of water.

26. The icemaker assembly of claim 25, wherein:

said ice tray includes a first partition member interposed between said first quantity of water and said second quantity of water, and said first partition member has defined therein a first fluid passage.

27. The icemaker assembly of claim 26, wherein:

said ice tray further includes a second partition member spaced apart from said first partition member so as to define said first space, and said second partition member has defined therein a second fluid passage.

28. The icemaker assembly of claim 26, wherein:

said ice tray further includes an end wall spaced apart from said first partition member so as to define said second space, said end wall has a bearing surface defined therein, and a shaft of said ice ejector is positioned in contact with said bearing surface.

29. The icemaker assembly of claim 25, wherein said ice ejector further includes a shaft, and said first ejector member and said second ejector member are each secured to said shaft.

30. The icemaker assembly of claim 25, wherein:

said icemaker assembly has a plurality of ice forming compartments that includes said first ice forming compartment, said second ice forming compartment, and additional ice forming compartments, and said additional ice forming compartments each possesses the same physical configuration as said first ice forming compartment and said second ice forming compartments.

31. The icemaker assembly of claim 30, wherein said plurality of ice forming compartments includes seven ice forming compartments.

32. The icemaker assembly of claim 31, wherein said ice ejector has a plurality of ejector members that includes said first ejector member and said second ejector member, and additional ejector members, and said additional ejector members each possesses the same physical configuration as said first ejector member and said second ejector member.

33. The icemaker assembly of claim 25 and further comprising a first set of guides disposed on opposite sides of the first ice forming compartment and a second set of guides disposed on opposite sides of the second ice forming compartment, the guides being configured to permit the first and second ejector members to pass therebetween during rotation of the ice ejector and to guide ice cubes formed in the first and second ice forming compartments during ejection induced by the ice ejector.

* * * * *